US007403738B2

(12) United States Patent
Murakami et al.

(10) Patent No.: US 7,403,738 B2
(45) Date of Patent: Jul. 22, 2008

(54) DEVELOPER COLLECTING APPARATUS AND IMAGE FORMING APPARATUS HAVING THE SAME

(75) Inventors: Susumu Murakami, Kyoto (JP); Hideaki Kadowaki, Kyoto (JP); Yasuhiro Takai, Sakurai (JP)

(73) Assignee: Sharp Kabushiki Kaisha, Osaka (JP)

( * ) Notice: Subject to any disclaimer, the term of this patent is extended or adjusted under 35 U.S.C. 154(b) by 197 days.

(21) Appl. No.: 11/442,556

(22) Filed: May 30, 2006

(65) Prior Publication Data

US 2006/0269305 A1 Nov. 30, 2006

(30) Foreign Application Priority Data

May 31, 2005 (JP) ..... 2005-159797

(51) Int. Cl.
*G03G 21/00* (2006.01)

(52) U.S. Cl. ..... 399/360

(58) Field of Classification Search ..... 399/35, 399/120, 358–360

See application file for complete search history.

(56) References Cited

U.S. PATENT DOCUMENTS 5,634,172 A * 5/1997 Manabe ..... 399/35

FOREIGN PATENT DOCUMENTS

| | | | |
|---|---|---|---|
| JP | 2000-259054 | A | 9/2000 |
| JP | 2003-345203 | A | 12/2003 |
| JP | 2004-335499 | A | 11/2004 |
| JP | 2005-49528 | A | 2/2005 |

* cited by examiner

*Primary Examiner*—Ryan Gleitz
(74) *Attorney, Agent, or Firm*—Birch, Stewart, Kolasch & Birch, LLP

(57) ABSTRACT

A developer collecting apparatus for collecting waste developer which is generated by cleaning residual developer remained on a photoreceptor and an intermediate transfer body, includes: a waste developer container for accommodating the waste developer; a stirring member rotatably provided in the waste developer container, for stirring the waste developer; and a driving section for giving a rotary driving force to the stirring member. The driving section of the stirring member has: a driving source; a first driving force transmitting path and a second driving force transmitting path which are coupled on the driving source, for transmitting the rotary driving force to the stirring member, and when a rotational load on the first driving force transmitting path reaches a predetermined level or more, a switch-over of transmitting path can be performed from the first driving force transmitting path to the second driving force transmitting path.

7 Claims, 11 Drawing Sheets

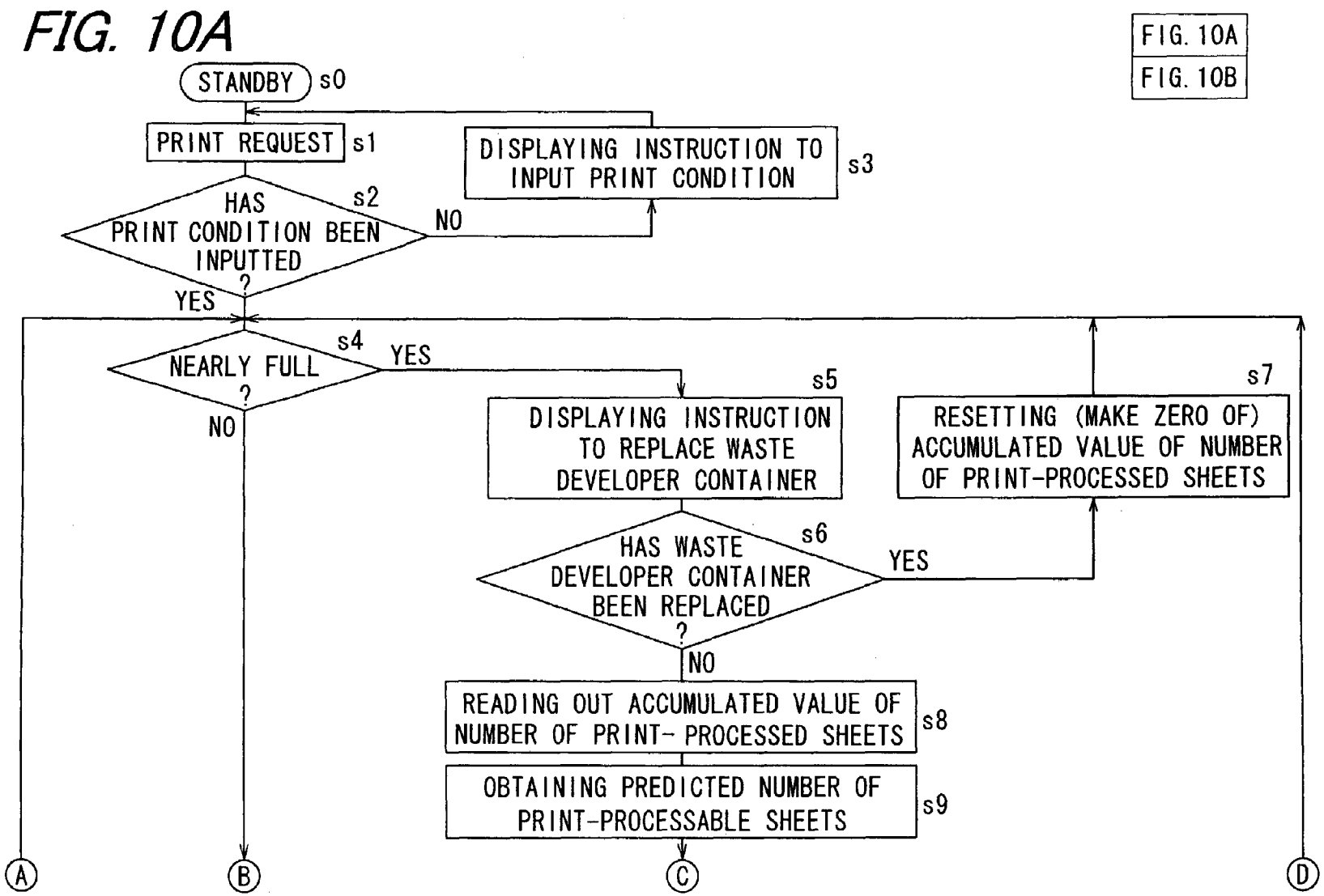
FIG. 10A
FIG. 10B
STANDBY
s0
PRINT REQUEST
s1
HAS PRINT CONDITION BEEN INPUTTED ?
s2
NO
YES
DISPLAYING INSTRUCTION TO INPUT PRINT CONDITION
s3
NEARLY FULL ?
s4
YES
NO
DISPLAYING INSTRUCTION TO REPLACE WASTE DEVELOPER CONTAINER
s5
HAS WASTE DEVELOPER CONTAINER BEEN REPLACED ?
s6
YES
NO
RESETTING (MAKE ZERO OF) ACCUMULATED VALUE OF NUMBER OF PRINT-PROCESSED SHEETS
s7
READING OUT ACCUMULATED VALUE OF NUMBER OF PRINT- PROCESSED SHEETS
s8
OBTAINING PREDICTED NUMBER OF PRINT-PROCESSABLE SHEETS
s9
A
B
C
D

DEVELOPER COLLECTING APPARATUS AND IMAGE FORMING APPARATUS HAVING THE SAME

BACKGROUND OF THE INVENTION

1. Field of the Invention

The present invention relates to a developer collecting apparatus and an image forming apparatus having the developer collecting apparatus.

2. Description of the Related Art

In recent years, it has been gradually more common in an image forming apparatus to shift printing in black and white to printing in full color. Moreover, along with development of the image forming apparatus, a color image forming apparatus has been utilized for general purposes. Among the color image forming apparatuses, especially for an image forming apparatus which employs an electrophotographic system, an indirect transfer system has been often proposed in an attempt to meet miniaturization of the apparatus and speeding up of color image formation. The indirect transfer system is characterized by the following processes in formation of a color image onto recording paper. Firstly, a developer image is formed (first transfer) by stacking image information separated in color for each color component from an electrostatic latent image bearing member (hereinafter may be referred to as a photoreceptor) respectively provided on a plurality of image forming units (also referred to as a process printing unit) onto an intermediate transfer body. And then, the developer image processed by the first transfer is totally transferred (second transfer) onto the recording paper serving as a transfer-subjected medium.

In general, it is well known that, when the first transfer is carried out from a photoreceptor to an intermediate transfer body at a transfer step in the image formation, not all the developer which forms a developer image on the photoreceptor is transferred onto the intermediate transfer body, but a little developer remains on the photoreceptor. It is known that a transfer efficiency of the first transfer is approximately 90%. Also at a second transfer step for transferring the developer image on the intermediate transfer body onto the recording paper, residual developer is generated as in the above case.

Consequently, the image forming apparatus is usually provided with a cleaning apparatus for collecting the residual developer remaining on the photoreceptor and the intermediate transfer body at the first and second transfer steps and in addition, a developer collecting apparatus for collecting as waste developer the residual developer which has been cleaned by the cleaning apparatus. However, in order to provide a plurality of the developer collecting apparatuses for a plurality of the image forming units and the intermediate transfer body, a larger space in the apparatus will be necessary therefor, which is not favorable in terms of compact design, decrease of user's operability, and pollution inside the apparatus due to the waste developer.

In consideration of the above points, the applicant has proposed an integrally-formed developer collecting container for accommodating waste developer generated from a plurality of residual developer sources in Japanese Patent Application No. 2004-335499 so as to solve the above problems.

In the above proposal, integration of the container is realized, and problems for compact design or the like can be solved. However, there arises a problem that even when an amount of the waste developer accommodated in a waste developer container does not reach a capacity (this capacity is hereinafter referred to as a full state), a drive for rotating stirring member for stirring the waste developer accommodated in the waste developer container stops so that the stirring member is locked. Moreover, the drive for rotating the stirring member stops before the waste developer container becomes full of the waste developer, and as a result, it is not possible to collect the waste developer even when the waste developer container is not filled up with the waste developer. This leads to a problem that an image forming operation is forced to stop in order to prevent the pollution inside the apparatus and pollution on the image caused by the waste developer which cannot be collected.

In a related art, a photosensor is utilized for determining whether or not the waste developer container is filled up with the waste developer (for example, refer to Japanese Unexamined Patent Publication JP-A 2003-345203). In the art disclosed in JP-A 2003-345203 is provided a detecting switch for detecting whether or not a waste toner box serving as a waste developer container is mounted on an apparatus main body, and a photosensor which operates either in a translucent state or in a light shielding state when the detecting switch is turned on while the photosensor is brought to the same state as the translucent state when the detecting switch is turned off. When the detecting switch is turned on and the photosensor is in the light shielding state, it is determined that the waste toner box is filled up with the waste developer.

However, the art of JP-A 2003-345203 includes a problem that significantly careful check is required for the switches or the like, in order to determine whether the waste toner box is mounted and full with waste developer or the waste toner box is not mounted but a signal indicating a full state is outputted, because the photosensor is brought to the same state as the translucent state even when the detecting switch is turned off, specifically when the waste toner box is not mounted on the apparatus main body.

Further, the method of detecting an accommodated amount of the waste developer in the waste toner box through the photosensor may lead false detection since the waste toner accumulated in the container is excellent in fluidity, with the result that the waste toner contaminates an inner wall portion of the container due to flowing of the waste toner inside the container, which leads decrease of detecting accuracy of the photosensor. Furthermore, a first notice is suddenly given by the detection through the photosensor when the waste toner box is filled up with the waste developer, with the result that there arises a problem that the image forming operation is forced to stop during image formation in order to replace the waste toner box.

SUMMARY OF THE INVENTION

An object of the invention is to provide a developer collecting apparatus capable of preventing a locking phenomenon of a stirring member provided in a waste developer container, for stirring waste developer, and reliably accommodating e waste developer up to full capacity of the waste developer container and capable of predicting a nearly full state of the waste developer container, and to provide an image forming apparatus having the developer collecting apparatus.

Further, another object of the invention is to provide a print processing method of an image forming apparatus capable of realizing a reliable print processing until waste developer is accommodated up to full capacity of a waste developer container, based on a prediction outputted from a developer collecting apparatus, indicating that the waste developer container is in a nearly full state.

The invention provides a developer collecting apparatus for an image forming apparatus comprising an image forming unit composed of an image bearing member on which an electrostatic latent image is formed by being exposed to light in accordance with image information, and a developing portion for forming a developer image by developing the electrostatic latent image on the image bearing member; an intermediate transfer body onto which the developer image formed on the image bearing member is transferred; a transfer portion for totally transferring onto a recording medium the developer image transferred on the intermediate transfer body; and a cleaning section for removing from the image bearing member and the intermediate transfer body, residual developer remaining on the image bearing member which is not transferred from the image bearing member onto the intermediate transfer body, and residual developer remaining on the intermediate transfer body which is not transferred from the intermediate transfer body onto the recording medium, the developer collecting apparatus which collects developer removed from the image bearing member and the intermediate transfer body by the cleaning section, the developer collecting apparatus comprising:

a positioning frame for positioning the image bearing member to be mounted onto an image forming apparatus main body;

a waste developer container detachably mounted on the positioning frame, for accommodating waste developer removed by the cleaning section;

a stirring member rotatably provided in the waste developer container, for stirring waste developer accommodated in the waste developer container; and a driving section for giving a rotary driving force to the stirring member, the driving section having:

a driving source; and a first driving force transmitting path and a second driving force transmitting path which are coupled to the driving source, for transmitting the rotary driving force to the stirring member, and when a rotational load on the first driving force transmitting path reaches a predetermined level or more, switch-over of transmitting path for transmitting the rotary driving force to the stirring member is performed from the first driving force transmitting path to the second driving force transmitting path.

According to the invention, the developer collecting apparatus comprises the stirring member rotatably provided in the waste developer container, for stirring the waste developer accommodated in the waste developer container; and the driving section for giving the rotary driving force to the stirring member, the driving section having the first driving force transmitting path and second driving force transmitting path which serve as two path coupled on the driving source, for transmitting the rotary driving force to the stirring member, with such a constitution that the switch-over of transmitting path for transmitting the rotary driving force to the stirring member is performed from the first driving force transmitting path to the second driving force transmitting path when the rotational load on the first driving force transmitting path reaches a predetermined level or more. By thus stopping the transmission of the driving force through the first driving force transmitting path and switching the driving force transmitting path into the second driving force transmitting path when the rotational load on the first driving force transmitting path reaches the predetermined level or more, it is possible to prevent the stirring member from undergoing the locking phenomenon in the first driving force transmitting path and moreover, it is possible to continue stirring the waste developer through the second driving force transmitting path and to accommodate the waste developer until the waste developer container is brought to a full state.

Further, in the invention, it is preferable that the first driving force transmitting path is provided on an extended line of a rotary shaft of the stirring member, and a first driving force transmitting shaft which is provided in the first driving force transmitting path and coupled to an output shaft of the driving source, is coupled to a rotary shaft of the stirring member in a state where the rotational load is less than the predetermined level, and detached from the rotary shaft of the stirring member in a state where the rotational load is the predetermined level or more.

Further, according to the invention, the first driving force transmitting path is provided on the extended line of the rotary shaft of the stirring member, and the first driving force transmitting shaft of the first driving force transmitting path, coupled to the output shaft of the driving force is coupled to or detached from the rotary shaft of the stirring member according to a level of the rotational load. By thus providing the first driving force transmitting path so as to directly connect the rotary shaft of the stirring member and the output shaft of the driving source, and coupling/removing such a transmitting path to/from the rotary shaft of the stirring member, it is possible to realize switching of the driving force transmitting path with a simple constitution without complicating the transmitting path.

Further, in the invention, it is preferable that the first driving force transmitting shaft has a first gear mounted in a vicinity of a shaft end portion close to the driving source, and the rotary shaft of the stirring member has a second gear mounted in a vicinity of an end portion of the rotary shaft, facing the first driving force transmitting shaft, and the second driving force transmitting path has:

a second driving force transmitting shaft; and a third gear and a fourth gear which are respectively mounted in a vicinity of both end portions in an axial direction of the second driving force transmitting shaft, and when the first driving force transmitting shaft is detached from the rotary shaft of the stirring member, the third gear of the second driving force transmitting shaft engages with the first gear of the first driving force transmitting shaft while the forth gear of the second driving force transmitting shaft engages with the second gear of the stirring member, whereby transmitting the rotary driving force of the driving source to the stirring member.

Further, according to the invention, transmission of the rotary driving force in the second driving force transmitting path to which the first driving force transmitting path is switched from, is carried out via the engagement of the gears, so that the rotary driving force can be reliably transmitted to the stirring member without loss including a slip.

Further, in the invention, it is preferable that the developer collecting apparatus further comprises a waste developer amount detecting sensor for detecting that an amount of the waste developer accommodated in the waste developer container reaches a predetermined amount, the waste developer amount detecting sensor detecting movement of the first driving force transmitting shaft when detached from the rotary shaft of the stirring member, whereby detecting that the amount of the waste developer being accommodated in the waste developer container reaches the predetermined amount.

Further, according to the invention, the waste developer amount detecting sensor detects the movement of the first driving force transmitting shaft when detached from the rotary shaft of the stirring member, thereby detecting that the amount of the waste developer accommodated in the waste developer container reaches the predetermined amount. Force loaded on the stirring member increases with an increase in the amount of the waste developer accommodated inside the waste developer container, that is, the amount of the waste developer which the stirring member has to stir. Accordingly, by relating a level of the rotational load put on the stirring member when the first driving force transmitting shaft is detached from the rotary shaft of the stirring member, to the predetermined amount of the waste developer being accommodated inside the waste developer container, thereby allowing the waste developer amount detecting sensor to detect the predetermined amount with accuracy.

Further, in the invention, it s preferable that the developer collecting apparatus further comprises:

a display portion on which information can be displayed; and a control unit for outputting to the display portion an operational command for display of information, the control unit making the display portion display replacement instruction information of the waste developer container, according to a detected output through the waste developer amount detecting sensor.

Further, according to the invention, the display portion on which information can be displayed, and the control unit for outputting to the display portion the operational command for the display of information are included, and since the control unit is constituted so as to be able to make the display portion display the replacement instruction information of the waste developer container according to the detected output through the waste developer detecting sensor, it is possible to replace the waste developer container with an empty one on a preferable time which is selected according to the display of information.

The invention provides an image forming apparatus comprising:

the developer collecting apparatus mentioned above; and a control unit for conducting control over operations of entire components according to image formation, the control unit which predicts in accordance with the detected output through the waste developer amount detecting sensor, a remaining capacity of the waste developer container until the waste developer container becomes full of the waste developer, and on a basis of the remaining capacity, obtains a predicted number of print-processable sheets, which is a predicted number of recording mediums that can be print-processed until the waste developer container becomes full of the waste developer.

Further, in the invention, it is preferable that the image forming apparatus further comprises:

a print processing section for print-processing a recording medium, being composed of an image forming unit having an image bearing member on which an electrostatic latent image is formed by exposure to light according to image information and a developing portion for developing the electrostatic latent image on the image bearing member into a developer image, an intermediate transfer body onto which the developer image formed on the image bearing member is transferred, and a transfer portion for totally transferring onto the recording medium the developer image which has been transferred onto the intermediate transfer body; and a number-of-print-processed-sheet detecting section for detecting a number of recording mediums which have been print-processed by the print processing section, wherein the control unit outputs an operational command to the print processing section to stop the print processing when an accumulated value of number of recording mediums reaches a predicted number of print-processable sheets, the recording mediums being print-processed in accordance with the detected output through the waste developer amount detecting sensor by the print processing section after receipt of the detected output.

According to the invention, the image forming apparatus comprises the developer collecting apparatus of the invention and the control unit for conducting the control over the entire components according to the image formation, and the control unit predicts in accordance with the detected output of the waste developer amount detecting sensor, the remaining capacity of the waste developer container until the waste developer container becomes full of the waste developer, and obtains the predicted number of print-processable sheets, which is the predicted number of recording mediums that can be print-processed until the waste developer container becomes full of the waste developer and preferably, when the number of print-processed recording mediums reaches the predicted number of print-processable sheets, the print processing operation is made to stop. By so doing, it is possible to reliably carry out the print processing until the waste developer container is brought to the full state without leading a vain act of stopping the print processing to replace the waste developer container even when the waste developer container is not full of the waste developer.

The invention provides a print processing method by use of an image forming apparatus comprising an image forming unit having an image bearing member on which an electrostatic latent image is formed by exposure to light according to image information and a developing portion for developing the electrostatic latent image on the image bearing member into a developer image, an intermediate transfer body onto which the developer image formed on the image bearing member is transferred, a transfer portion for totally transferring onto the recording medium the developer image which has been transferred onto the intermediate transfer body, a cleaning section for removing from the image bearing member and the intermediate transfer body, residual developer remaining on the image bearing member, which has not transferred from the image bearing member onto the intermediate transfer body, and residual developer remaining on the intermediate transfer body, which has not been transferred from the intermediate transfer body onto the recording medium, and a developer collecting apparatus for collecting the developer removed from the image bearing member and the intermediate transfer body by the cleaning section and accommodating the developer in a waste developer container, the print processing method comprising steps of:

detecting that an amount of the waste developer collected and accommodated in the waste developer container has reached an accommodation amount which is predetermined as an amount smaller than a full capacity of the waste developer container;

predicting a remaining capacity of the waste developer container until the waste developer container becomes full of the waste developer; and obtaining a predicted number of print-processable sheets on a basis of the remaining capacity, the predicted number representing a predicted number of recording mediums that can be print-processed until the waste developer container becomes full of the waste developer.

Further, in the invention, it is preferable that the print processing method further comprises, after the step of detecting that the amount of the accommodated waste developer reaches the predetermined accommodation amount, a step of stopping the print processing when an accumulated value of number of the recording mediums being print-processed reaches the predicted number of the print-processable sheets.

According to the invention, in the print processing method of the image forming apparatus having the developer collecting apparatus for collecting the waste developer, it is detected that the amount of the waste developer collected and accommodated in the waste developer container reaches the predetermined accommodation amount, and the remaining capacity from the predetermined accommodation amount to the full capacity of the waste developer container is predicted so that the predicted number of the print-processable sheets which number is a predetermined number on the basis of the remaining capacity, of the recording mediums that can be print-processed until the waste developer container is brought to a full state, and preferably when the accumulated value of number of recording mediums being print-processed reaches the predicted number of the print-processable sheets after detection of attainment of the predetermined accommodation amount, the print processing is made to stop. By so doing, it is possible to reliably carry out the print processing until the waste developer container is brought to a full state.

BRIEF DESCRIPTION OF THE DRAWINGS

Other and further objects, features, and advantages of the invention will be more explicit from the following detailed description taken with reference to the drawings wherein:

FIGS. 10A and 10B are flow charts of assistance in explaining a print processing control operation of the control unit on the basis of a detected result that an amount of waste developer accommodated in the waste developer container reaches a level of a nearly full state.

DETAILED DESCRIPTION OF THE PREFERRED EMBODIMENTS

Figure 1:
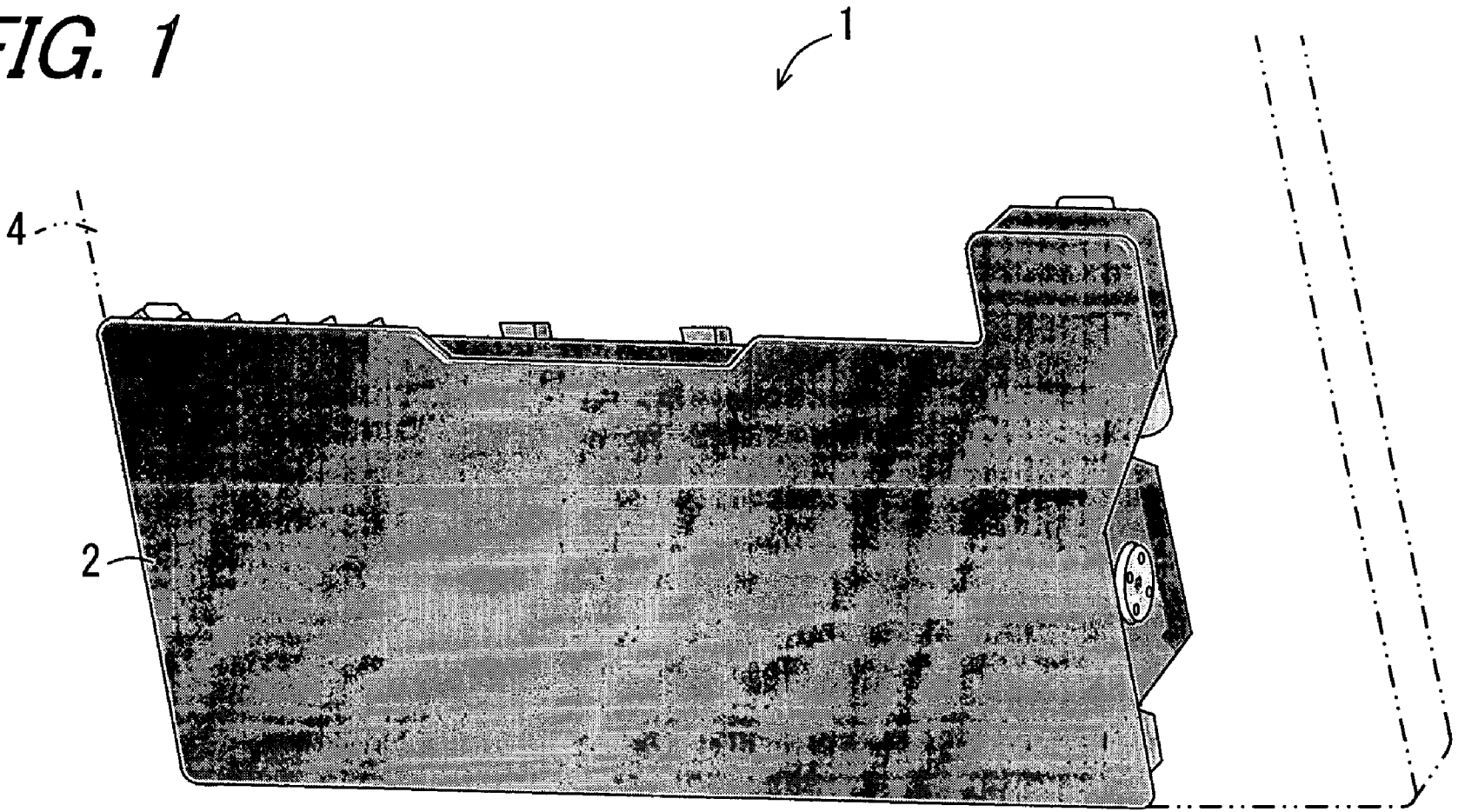
FIG. 1 is a perspective view showing an overview of a developer collecting apparatus according to one embodiment of the invention.

Now referring to the drawings, preferred embodiments of the invention are described below.

Figure 2:
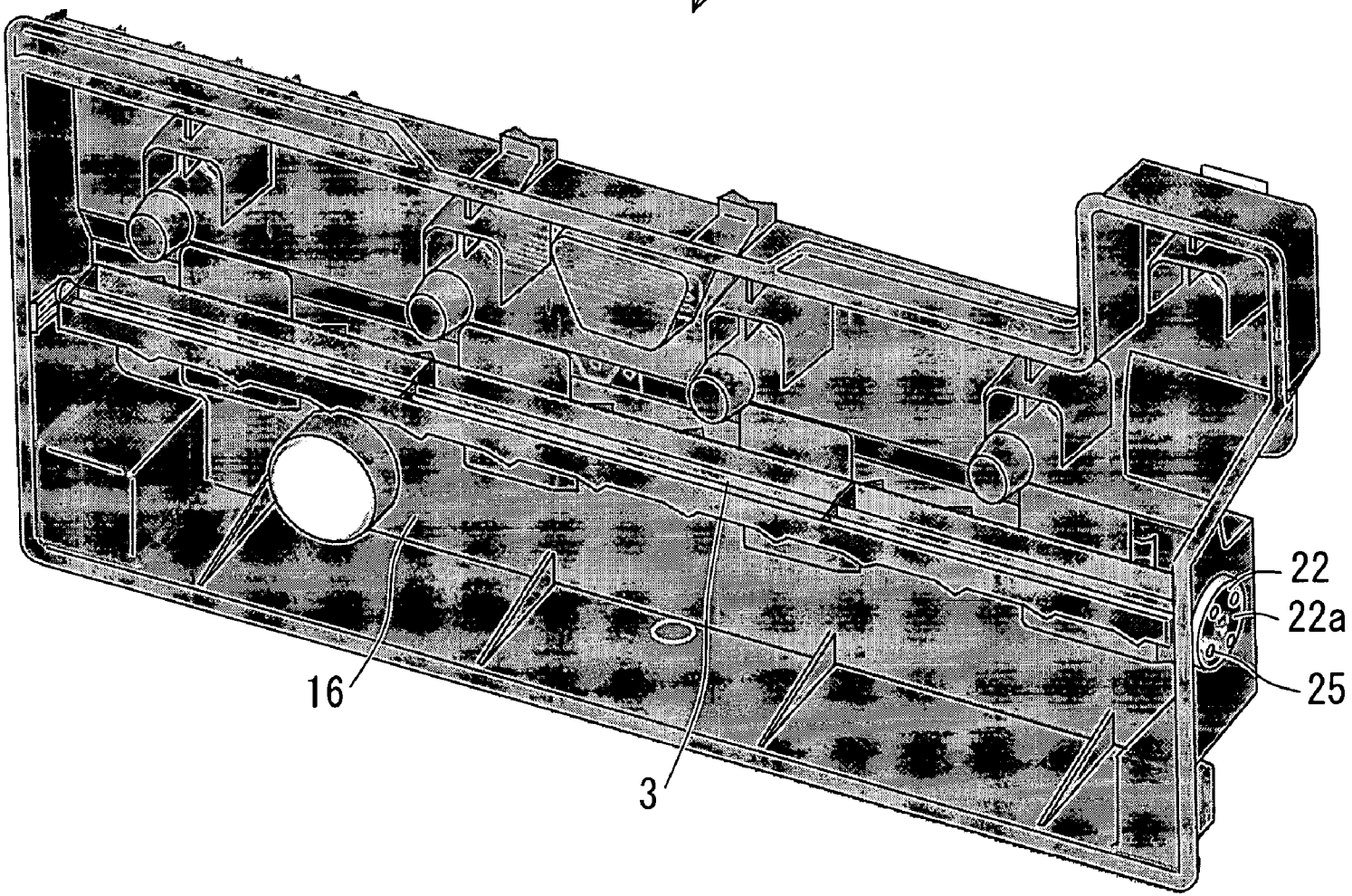
FIG. 2 is a view showing an internal constitution of a waste developer container provided in the developer collecting apparatus.
Figure 3A:
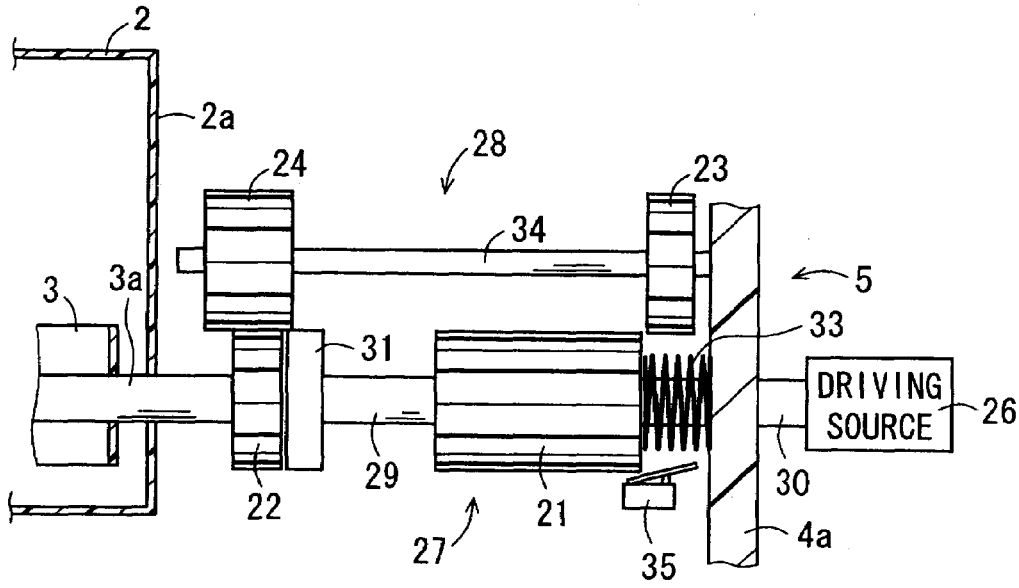
FIGS. 3A and 3B are views showing a configuration of a driving section provided in the developer collecting apparatus.
Figure 3B:
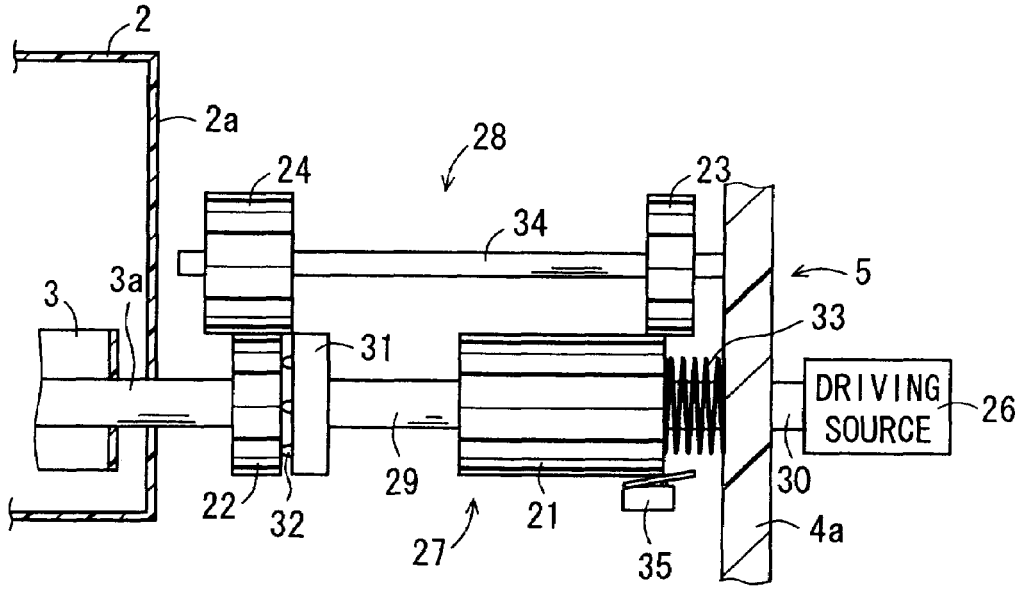
Figure 4:
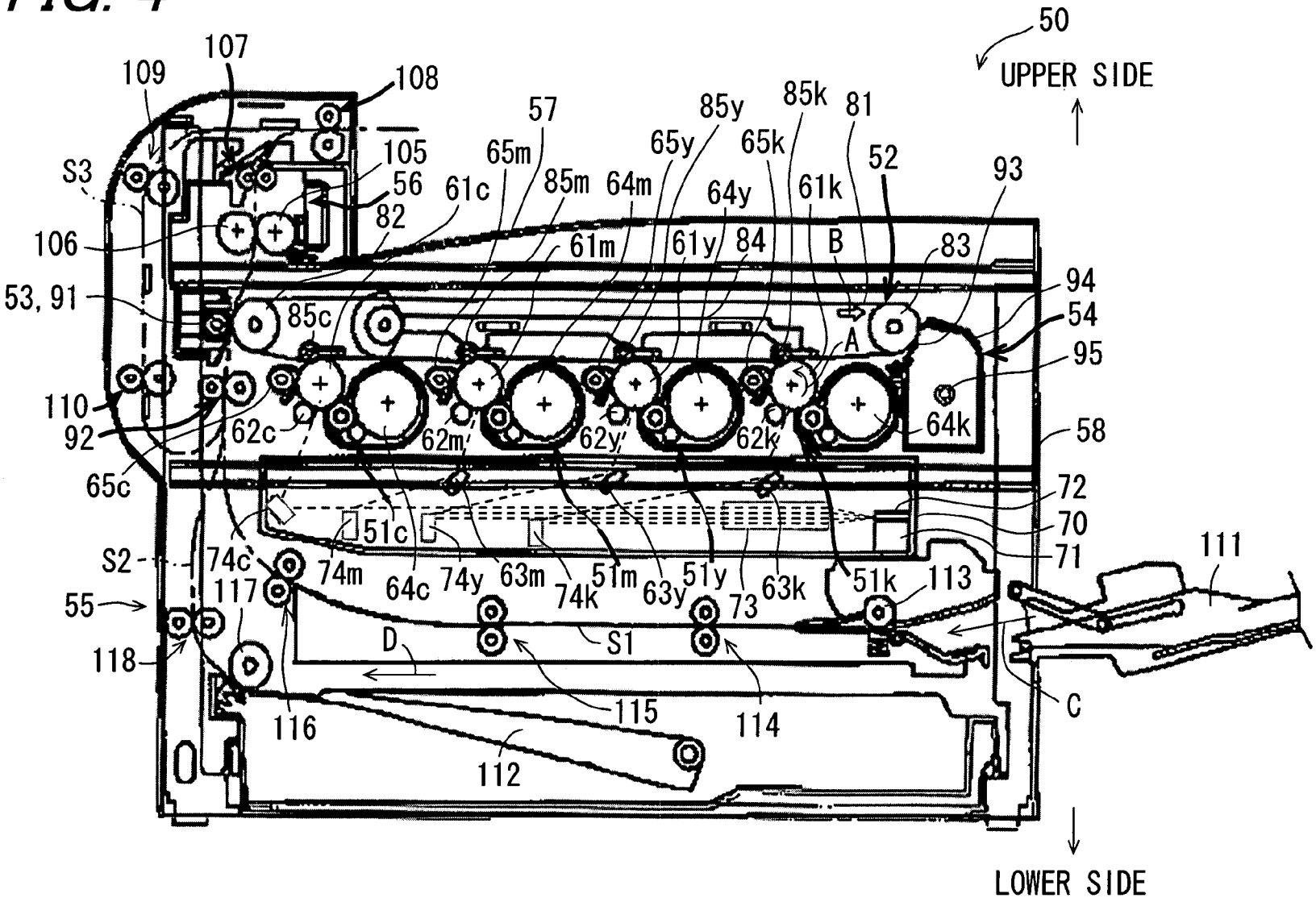
FIG. 4 is a view schematically showing an image forming apparatus provided with the developer collecting apparatus, according to another embodiment of the invention.

FIG. 1 is a perspective view showing an overview of a developer collecting apparatus 1 according to one embodiment of the invention. FIG. 2 is a view showing an internal constitution of a waste developer container 2 provided in the developer collecting apparatus 1. FIGS. 3A and 3B are views showing a configuration of a driving section 5 provided in the developer collecting apparatus 1. FIG. 4 is a view schematically showing an image forming apparatus 50 provided with the developer collecting apparatus 1, according to another embodiment of the invention.

With reference to FIG. 4, the developer collecting apparatus 1 is provided on the image forming apparatus 50 of which detail will be described hereinbelow. The image forming apparatus 50 comprises an image forming unit 51, an intermediate transfer body 52, a transfer portion 53, and cleaning sections 54 and 65. The image forming unit 51 is provided with an image bearing member 61 on which an electrostatic latent image is formed by exposure to a light in accordance with image information, and a developing portion 64 for developing the electrostatic latent image on the image bearing member 61 into a developer image. Onto the intermediate transfer body 52 is transferred the developer image formed on the image bearing member 61. The transfer portion 53 totally transfers the developer image which has transferred onto the image transfer body 52, onto a recording paper serving as a recording medium. The cleaning sections 54 and 65 remove from the image bearing member 61 and the intermediate transfer body 52, residual developer remaining on the image bearing member 61, which has not been transferred from the image bearing member 61 onto the intermediate transfer medium 52, and residual developer remaining on the intermediate transfer medium 52, which has not been transferred from the intermediate transfer medium 52 onto the recording paper. The developer collecting apparatus 1 collects the developer removed from the image bearing member 61 and the intermediate transfer body 52 through the cleaning sections 54 and 65. Hereinafter, the image bearing member 61 will be referred to as a photoreceptor 61.

The developer collecting apparatus 1 comprises a positioning frame 4, a waste developer container 2, a stirring member 3, and a driving section 5. The positioning frame 4 positions the photoreceptor 61 to be mounted in a case 58 serving as an image forming apparatus main body. The waste developer container 2 is detachably mounted on the positioning frame 4. In the waste developer container 2 is accommodated the waste developer removed by the cleaning sections 54 and 65. The stirring member 3 is rotatably provided in the waste developer container, and stirs the waste developer accommodated in the waste developer container 2. The driving section 5 gives a rotary driving force to the stirring member 3.

Figure 5:
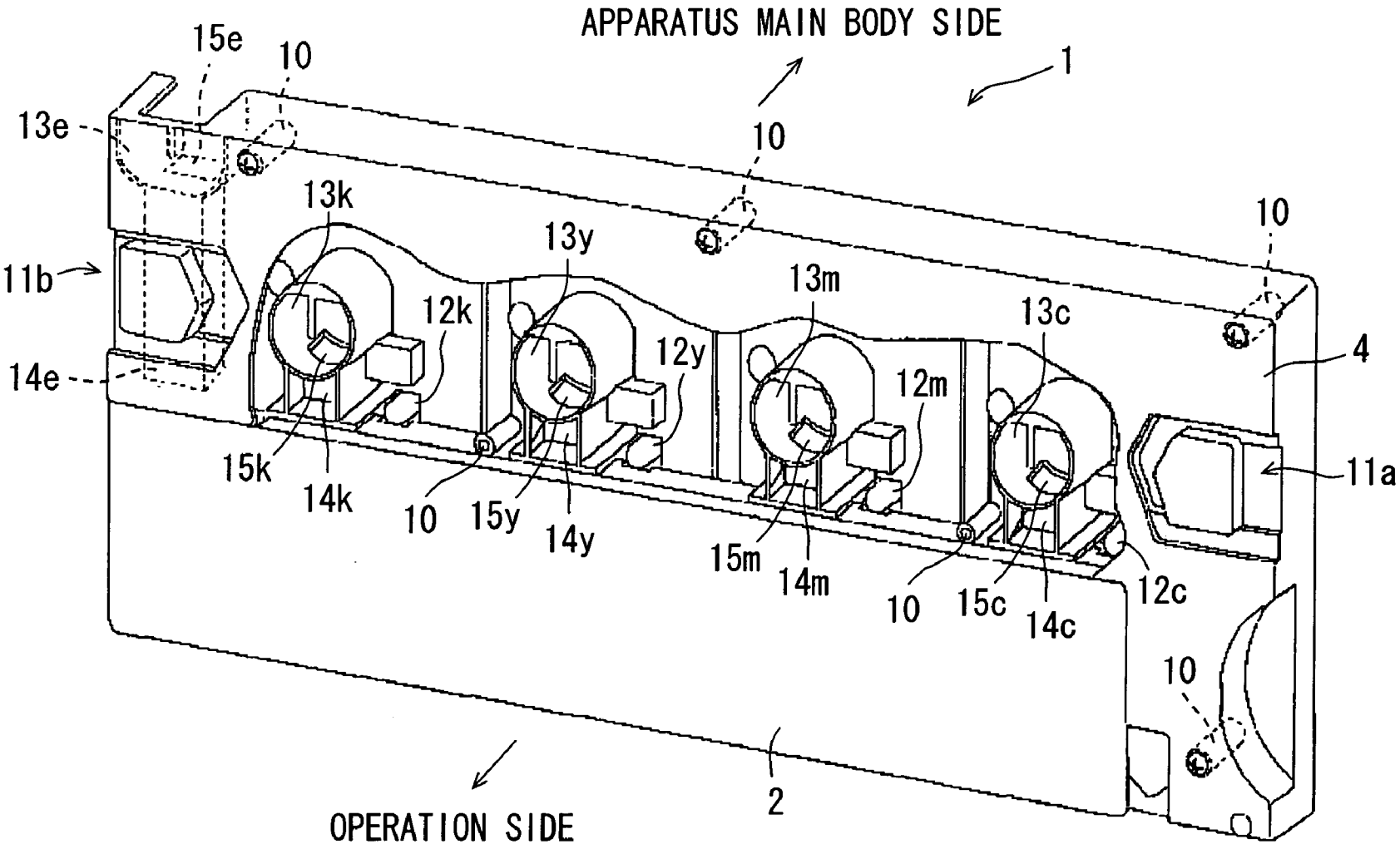
FIG. 5 is a view schematically showing a constitution of a positioning frame.

Hereinbelow, various parts for constituting the developer collecting apparatus 1 will be described. At the outset, descriptions will be given to the positioning frame 4. FIG. 5 is a view schematically showing a constitution of the positioning frame 4. The positioning frame 4 has a shape of long box extending along the image forming unit 51 and the intermediate transfer body 52 provided in the image forming apparatus 50. The positioning frame 4 is formed of, for example, hard synthetic resin. From behind the image forming apparatus 50 in a sheet of FIG. 4 showing the image forming apparatus 50 (hereinafter referred to as an operation side), the positioning frame 4 is mounted on the case 58.

Figure 6:
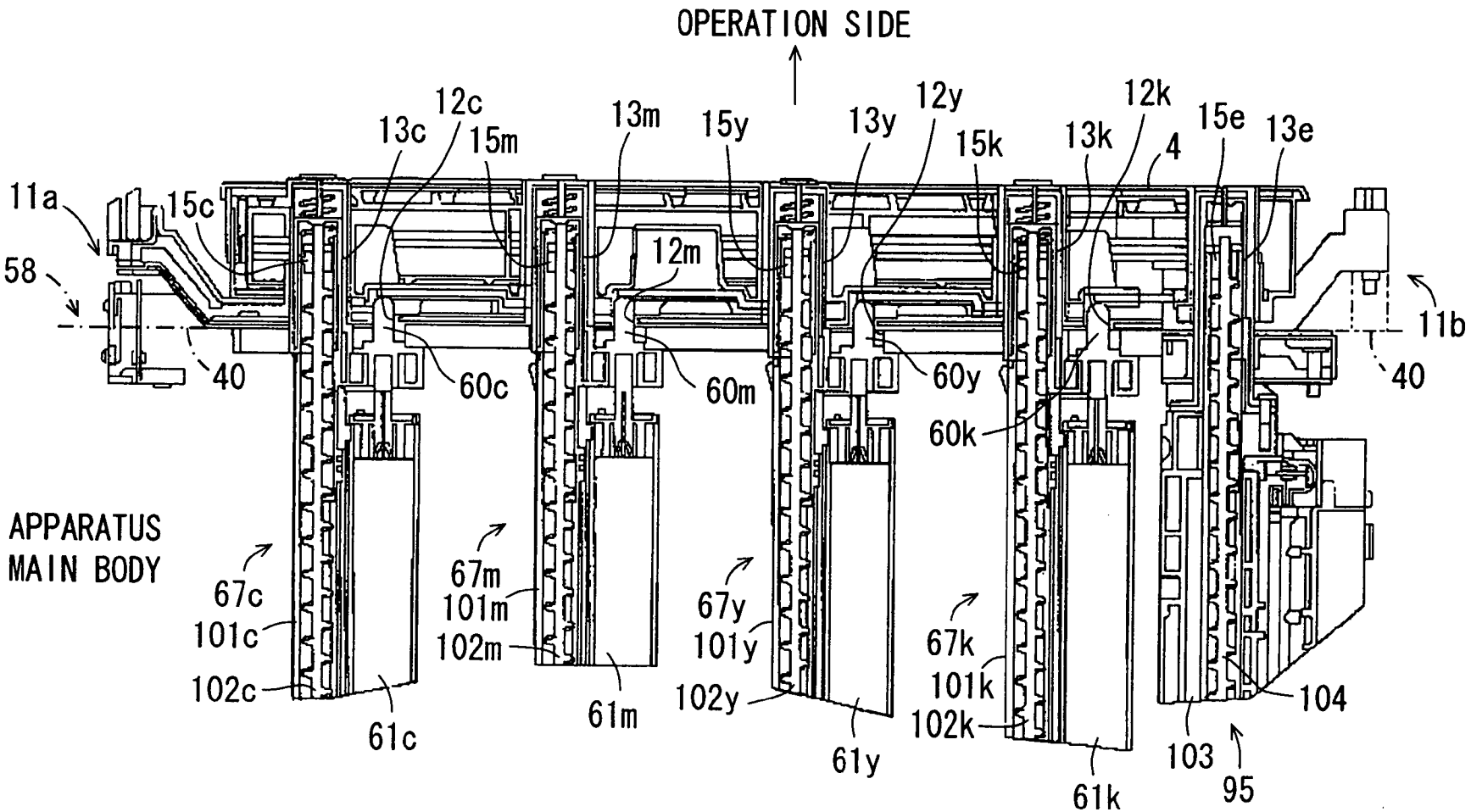
FIG. 6 is a longitudinal sectional view showing photoreceptors positioned by the positioning frame.

FIG. 6 is a longitudinal sectional view showing the photoreceptor 61 positioned by the positioning frame 4. Both end portions in the longitudinal direction (hereinafter referred to as a horizontal width direction) of the positioning frame 4 are provided with case-position positioning members 11*a* and 11*b* for positioning the case 58.

The case-position positioning members 11*a* and 11*b* have support function for supporting the positioning frame 4 when mounting the positioning frame 4 on the case 58. The positioning frame 4 is positioned on the case 58 in such a manner that the positioning frame 4 is positioned on a mounting face 40 of the case 58 by the case-position positioning members

11*a* and 11*b*. Positioning between the case-position positioning members 11*a*, 11*b* and the case is achieved by the following method. In this method, the positioning frame 4 is provided with positioning components such as a positioning pin, a positioning block, and a wedge-shaped fit, which components can be protruded therefrom. The case 58 is provided with an engaging member for engaging with the positioning component. The positioning component on the positioning frame 4 and the engaging member on the case 58 are made to be engaged with each other so that vertical and horizontal directions of the positioning frame 4 and case 58 are respectively positioned.

The positioning frame 4 has photoreceptor shaft support holes 12*k*, 12*y*, 12*m*, and 12*c*, each of which is formed at a portion corresponding to one end portion of a photoreceptor shaft 60 in the photoreceptor 61 of each of plural image forming units 51 provided in the image forming apparatus 50. The photoreceptor shaft support holes 12*k*, 12*y*, 12*m*, and 12*c* respectively engage with one end portion of each of photoreceptor shafts 60.

Moreover, photoreceptor cleaning sections 65*k*, 65*y*, 65*m*, and 65*c* serving as cleaning sections 65 on each of the image forming units 51 are respectively provided with photoreceptor waste toner conveying apparatuses 67*k*, 67*y*, 67*m*, and 67*c*. On the positioning frame 4 are formed waste developer collecting ports 13*k*, 13*y*, 13*m*, and 13*c*, each of which is formed at a portion corresponding to one end portion of each of the photoreceptor waste toner conveying apparatuses 67*k*, 67*y*, 67*m*, and 67*c* and positioned by respectively engaging with the one end portion of each of the photoreceptor waste toner conveying apparatuses 67*k*, 67*y*, 67*m*, and 67*c*. The transfer cleaning apparatuses 54 serving as a cleaning section provided on the intermediate transfer body 52 is provided with a transfer body waste toner conveying apparatus 95. On the positioning frame 4 is formed a waste developer collecting port 13*e* which is formed at a portion corresponding to one end portion of the transfer body waste toner conveying apparatus 95, and positioned by engaging with the one end portion of the transfer body waste toner conveying apparatus 95.

Below the waste developer collecting ports 13*k*, 13*y*, 13*m*, 13*c*, and 13*e* are formed waste developer passages 14*k*, 14*y*, 14*m*, 14*c*, and 14*e* which passages eventually lead to the waste developer container 2 the waste developer conveyed by the photoreceptor waste toner conveying apparatuses 67*k*, 67*y*, 67*m*, 67*c*, and transfer body waste toner conveying apparatus 95. Through each of waste developer passing holes 15*k*, 15*y*, 15*m*, 15*c*, and 15*e*, communication is obtained respectively between the waste developer collecting ports 13*k*, 13*y*, 13*m*, 13*c*, and 13*e* and the waste developer passages 14*k*, 14*y*, 14*m*, 14*c*, and 14*e*.

In other words, the residual developer (waste developer) removed from surfaces of the photoreceptor 61 and intermediate transfer body 52 by the photoreceptor cleaning sections 65*k*, 65*y*, 65*m*, 65*c*, and transfer body cleaning section 54 is sequentially conveyed with the assistance of the photoreceptor waste toner conveying apparatuses 67*k*, 67*y*, 67*m*, 67*c*, and transfer body waste toner conveying apparatus 95, to the waste developer container 2 in which the developer is to be collected, by way of the waste developer collecting ports 13*k*, 13*y*, 13*m*, 13*c*, and 13*e* of the positioning frame 4 and the waste developer passing holes 15*k*, 15*y*, 15*m*, 15*c*, and 15*e*, and furthermore the waste developer passages 14*k*, 14*y*, 14*m*, 14*c*, and 14*e*.

This positioning frame 4 is, after positioned by the case positioning members 11*a* and 11*b*, mounted on the case 58 by screw, bolt, or the like at a mounting portion 10 situated close to corner portions and side ends of the flame.

With reference back to FIG. 1 and FIG. 2, the waste developer container 2 detachably mounted on the lower part of the positioning frame 4. The waste developer container 2 is formed of, for example, hard synthetic resin. A shape of the waste developer container 2 is a hollow rectangular parallelepiped extending in the horizontal width direction. In an internal space 16 of the waste developer container 2 is provided a stirring member 3 extending in the horizontal width direction, for stirring the waste developer accommodated in the internal space 16. The stirring member 3 is rotatably supported by the waste developer container 2.

The stirring member 3 is given a rotary driving force from the driving section 5 so that the stirring member 3 rotates around a shaft line thereof. The stirring member 3 stirs the waste developer which is collected in the waste developer container 2 after passing through the waste developer passages 14*k*, 14*y*, 14*m*, 14*c*, and 14*e*, and equalizes an accommodation height of the waste developer accommodated in the waste developer container 2. The stirring member 3 thus allows the waste developer container 2 to reliably accommodate the waste developer up to a designed capacity by controlling the accommodation height of the waste developer so as not to locally exceed the collection capacity.

Next, with reference back to FIG. 3A and FIG. 3B, will be explained an operation of switch-over in the driving section 5 between a first driving force transmitting path 27 and a second driving force transmitting force 28 according to the rotational load on the stirring member 3.

When an amount of the waste developer accommodated in the waste developer container 2 is small so that the stirring member 3 is not in contact with the waste developer, the rotational load on the stirring member 3 at the time of rotation of the stirring member 3 is small. However, with increase in the amount of the waste developer accommodated in the waste developer container 2, the rotational load on the stirring member 3 becomes larger with an increased buried degree of the stirring member 3 into the waste developer, exemplified by such cases, for example, that the stirring member 3 rotates in the waste developer accommodated up to the vicinity of a rotary shaft line of the stirring member 3 and that the stirring member 3 rotates in a state of being totally buried in the waste developer.

A shaft center member 3*a* of the stirring member 3, having a shaft rotatably supported by the waste developer container 2 penetrates a side wall 2*a* of the waste developer container 2 so that outside the side wall 2*a*, a second gear 2 is attached to one end portion of the shaft center member 3*a* so as to have the same axis as that of the stirring member 3. As shown in FIG. 2, on a boss portion 22*a* are formed a plurality (in the embodiment, four pieces) of engaging concave areas 25 which are semispherical recesses, radially from the rotary shaft center.

The driving section 5 for rotationally driving the stirring member 3 has a driving source 26 composed of an electric motor, for example, and a first driving force transmitting path 27 and a second driving force transmitting path 28 which are two paths coupled on the driving source 26, for transmitting the rotary driving force from the driving source 26 to the stirring member 3.

The first driving force transmitting path 27 has a first driving force transmitting shaft 29 provided on an extended line of the shaft center member 3*a* which forms a rotary shaft of the stirring member 3. The first driving force transmitting shaft 29 is coupled on an output shaft 30 of the driving source 26, and in a state where the rotational load is less than a predetermined level, the first driving force transmitting shaft 29 is coupled on the shaft center member 3*a* of the stirring member 3, and in a state where the rotational load is a predetermined level or more, the first driving force transmitting shaft 29 is detached from the shaft center member 3*a* of the stirring member 3.

A flange portion 31 is provided on an end portion of the first driving force transmitting shaft 29, facing the stirring member 3. On the flange portion 31, an engaging convex portion 32 is formed at a position corresponding to a position of the engaging concave area 25 formed on the boss portion 22*a* of the second gear 22 provided on the stirring member 3, and also formed into size and shape corresponding to those of the engaging concave area 25. To the vicinity of a shaft end portion of the first driving force transmitting shaft 29, which shaft end portion is opposite to the flange portion 31, that is, close to the driving source 26 is attached the first gear 21. The first gear 21 is coupled at the shaft center portion thereof on the output shaft 30 of the driving source 26 so as to be capable of slidingly moving in an extending direction of the fist driving force transmitting shaft 29. The driving force 26 is disposed outside the side wall frame 4*a* of the positioning frame 4, and the output shaft 30 of the driving force 26 penetrates the side wall frame 4*a* to be slidably coupled on the first gear 21 of the first driving force transmitting shaft 29.

Between the first gear 21 and the side wall frame 4*a* is provided a coil spring member 33 so as to bias the flange portion 31 of the first driving force transmitting shaft 29 against the second gear 22. Accordingly, by means of bias force of the coil spring member 33, the flange portion 31 of the first driving force transmitting shaft 29 is biased against the second gear 22 so that the engaging convex portion 32 of the flange portion 31 engages with the engaging concave area 25 of the second gear 22.

The rotary driving force of the driving source 26 is thus transmitted, by way of the output shaft 30 thereof, the first driving force transmitting shaft 29, and the flange portion 31 in this order, and through the engagement between the engaging convex portion 32 and the engaging concave area 25, to the second gear 22 against which the flange portion 31 is biased by the bias force of the coil spring member 33 so that the stirring member 3 having the second gear 22 attached thereto is rotated.

As described before, the rotational load on the stirring member 3 increases as the waste developer being accommodated in the waste developer container 2 increases, with the result that when the rotational load overcomes the bias force of the coil spring 33, the engaging portions in the semispherical form start to slide with each other so that the first driving force transmitting shaft 29 slidingly move in the axial direction thereof, and then the flange portion 31 is detached from the second gear 22. Accordingly, a predetermined amount of the developer is selected from levels less than the capacity (full state) of the waste developer container 2, and the rotational load on the stirring member 3 corresponding to this predetermined amount is obtained to determine elastic force of the coil spring member 33 for biasing the flange portion 31 against the second gear 22, so as to counterpoise this rotational load, and by so doing, it is possible to cut the first driving force transmitting path 27 in a state where the rotational load is the predetermined level or more.

The level of the predetermined rotational load, which serves as a standard level for cutting the first driving force transmitting path 27 is not particularly limited, but can be determined to a given level as a design concept of the apparatus. As one example in the embodiment, in a case where the stirring member 3 is buried in the waste developer up to two third of a dimension in a direction perpendicular to a shaft line of the stirring member 3, a level of rotational torque loaded on the stirring member 3 is recognized as a level of the predetermined rotational load. Here, a state where the amount of the waste developer being accommodated in the waste developer container 2 has reached a height of two third of the dimension of the stirring member 3 in the direction perpendicular to the shaft line of the stirring member 3 is referred to as a nearly full state because the waste developer container 2 is not completely full, but nearly full of the waste developer.

In the meantime, the second driving force transmitting path 28 has a second driving force transmitting shaft 34, and third gear 23 and forth gear 24 which are respectively attached to both end portions in an axial direction of the second driving force transmitting shaft 34. When the first driving force transmitting shaft 34 is detached from the shaft center member 3a serving as a rotary shaft of the stirring member 3, the third gear 23 of the second driving force transmitting shaft 34 engages with the first gear 21 of the first driving force transmitting shaft 29 while the fourth gear 24 of the second driving force transmitting shaft 34 engages with the second gear 22 of the stirring member 3. Through these engagements, the rotary driving force of the driving source 26 is transmitted to the stirring member 3.

In other words, when the amount of the waste developer collected in the waste developer container 2 reaches a level of the nearly full state, the rotational load on the stirring member 3 becomes the predetermined level and therefore, the second gear 22 and the flange portion 31 start to slide with each other at the engaging portion so that the first driving force transmitting shaft 29 moves toward the driving source 26. Through the movement of the first driving force transmitting shaft 29 toward the driving source 26, the first gear 21 engages with the third gear 23 of the second driving force transmitting shaft 34. By means of the engagement between the first gear 21 and the third gear 23, the rotary driving force of the driving source 26 is transmitted to the second driving force transmitting shaft 34 through the output shaft 30 of the driving source 26, the first gear 21, and the third gear 23. The rotary driving force transmitted to the second driving force transmitting shaft 34 is transmitted to the stirring member 3 by way of the fourth gear 24, and further the second gear 22 engaging with the fourth gear 24, and the shaft center member 3*a*, so that the stirring member 3 is rotatably driven.

As described above, in the developer collecting apparatus 1, when the rotational load on the first driving force transmitting path 27 is equal to or more than the predetermined level corresponding to a state where the waste developer container 2 is in a nearly full state, the transmitting path of the rotary driving force for the stirring member 3 is switched from the first driving force transmitting path 27 to the second driving force transmitting path 28 so that even after the waste developer container 2 becomes in the nearly full state, it is possible for the stirring member 3 to stir the waste developer and thus equalize the accommodation height of the waste developer in the container. This makes it possible to reliably accommodate the waste developer until the waste developer container 2 is brought to the full state.

Further, in the developer collecting apparatus 1 of the embodiment is further provided a waste developer amount detecting sensor 35 for detecting that the amount of the waste developer accommodated in the waste developer container 2 has reached a level of the nearly full state. The detecting system of the waste developer amount detecting sensor 35 is not particularly limited, and it is thus possible to use a mechanical sensor, an optical sensor, and the like. In the embodiment, the mechanical sensor is used as the waste developer amount detecting sensor 35, and the waste developer amount detecting sensor (mechanical sensor) 35 is provided at a position where the waste developer amount detecting sensor 35 can be turned on in a state where the first driving force transmitting shaft 29 has moved toward the driving source 26. That is to say, by detecting the movement of the first driving force transmitting shaft 29 when detached from the shaft center member 3a of the stirring member 3, the waste developer amount detecting sensor 35 detects that the amount of the waste developer accommodated in the waste developer container 2 has reached a predetermined level of the nearly full state.

Figure 7:
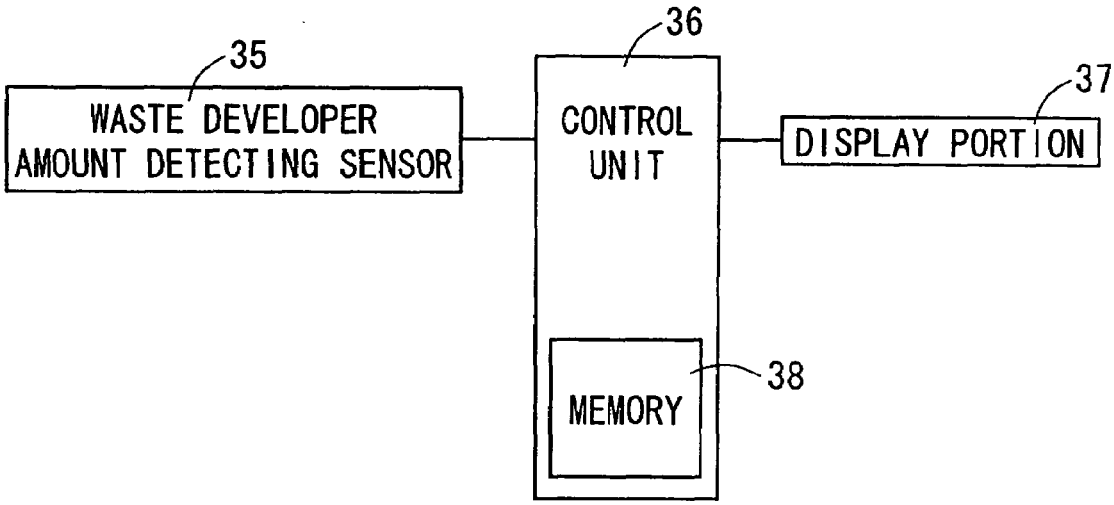
FIG. 7 is a block view showing an electrical constitution according to a control operation of a control unit provided in the developer collecting apparatus.

FIG. 7 is a block view showing an electrical constitution according to a control operation of a control unit 36 provided in the developer collecting apparatus 1. The developer collecting apparatus 1 further comprises a display portion 37 on which information can be displayed, and the control unit 36 for outputting the operational command for display of information to the display portion 37.

The control unit 36 is realized by a process circuit including a central processing unit (CPU), for example, and a memory 38.serving as a storing portion is provided together with the control unit 36. Note that when the developer collecting apparatus 1 is mounted on such an image forming apparatus 50 shown in FIG. 4, a control unit of the image forming apparatus 50 may be used as the control unit 36 of the developer collecting apparatus 1. In the embodiment, the memory 38 has previously stored information of replacing the waste developer container. The display portion 37 is realized by a liquid crystal display (LCD), for example.

According to the output at the time when the rotational load on the stirring member 3 increases and the first driving force transmitting shaft 29 moves so that the first driving force transmitting path 27 is cut and the first gear 21 turns on the waste developer amount detecting sensor 35 which is a mechanical sensor, that is, according to the detected output through the waste developer amount detecting sensor 35, indicating the nearly full state, the control unit 36 reads out replacement instruction information for replacing the waste developer container 2 which replacement instruction information is previously stored in the memory 38, and makes the display portion 37 display the information.

When the waste developer container 2 is brought to a nearly full state, the replacement instruction information is thus clarified on the display portion 37. This allows an operator to select any given time, at which time the image information is not affected, for replacing the waste developer container 2 when the developer collecting apparatus 1 is mounted in the image forming apparatus.

Next, with reference back to FIG. 4, the image forming apparatus 50 according to another embodiment of the invention will be described. The image forming apparatus 50 is characterized in comprising the developer collecting apparatus 1.

The image forming apparatus 50 comprises a plurality of image forming units 51, an intermediate transfer body 52, a photoreceptor cleaning apparatus 65, a transfer body cleaning apparatus 54, the developer collecting apparatus 1 of the invention, a feeding portion 55, a fixing portion 56, a discharging portion 57, and a conveyance system. Each of the image forming units 51 is provided with a photoreceptor 61 on which an electrostatic latent image is formed by exposure to light in accordance with image information separated in color, and a developing portion 64 for developing the electrostatic latent image on the photoreceptor 61 into a developer image. A print processing section 41 comprises the image forming unit 51, the intermediate transfer body 52, and the transfer portion 53. The feeding portion 55 feeds the recording paper. Through the conveyance system, the recording paper is conveyed inside the apparatus main body.

On the intermediate transfer body 52 are stacked a plurality of the developer images formed on the photoreceptor 61 of the image forming unit 51 so that the developer images are transferred onto the intermediate transfer body 52. The transfer portion 53 totally transfers the developer image transferred on the image transfer body 52 onto recording paper serving as a transfer-subjected medium.

The photoreceptor cleaning apparatus 65 removes from the photoreceptor 61 residual developer remaining on the photoreceptors 61 which has not been transferred from the photoreceptors 61 onto the intermediate transfer medium 52. The transfer body cleaning apparatus 54 removes from the intermediate transfer body 51 residual developer remaining on the intermediate transfer medium 52 which has not been transferred from the intermediate transfer medium 52 onto the recording paper. The developer collecting apparatus 1 of the invention collects the developer, that is, the waste developer, removed by the photoreceptor cleaning apparatus 65 and the transfer body cleaning apparatus 54. The fixing portion 56 fixes the developer image transferred onto the recording paper. Onto the discharging portion 57 is discharged the recording paper on which the developer image has been fixed.

This image forming apparatus 50 is, for example, a digital color printer. By the image forming apparatus 50, a full-color image or a black-and-white image is formed on recording paper, on the basis of a print job from information processors such as an externally-connected personal computer. The image forming apparatus 50 is disposed so that an operator operates the apparatus from behind the sheet of FIG. 4. Accordingly, in a case where the operator faces the image forming apparatus 50 for operation, right and left in a horizontal direction are opposite to those in a case where the image forming apparatus 50 is seen from an anterior view of FIG. 4.

Hereinafter will be described each portion of the image forming apparatus 50.

The image forming apparatus 50 according to the embodiment is a full-color image forming apparatus. The image forming unit 51 for forming an image for each color component by separating the image information in color is provided so as to correspond to four color components of black (k), yellow (y), magenta (m), and cyan (c). The four image forming units 51 are different only in color thereof, with the same configuration. Accordingly, an image forming unit 51*k* for black (k) will be described as a representative example of the configuration so as to omit descriptions of the image forming units 51*y*, 51*m*, and 51*c* for the other color components. Note that, with regard to the image forming unit 51, the photoreceptor cleaning apparatus 65, or the like which is provided for each color component, an alphabet indicating a color component is given herein to each element after a reference numeral thereof while only reference numeral is given in a case where the elements are collectively referred.

Figure 8:
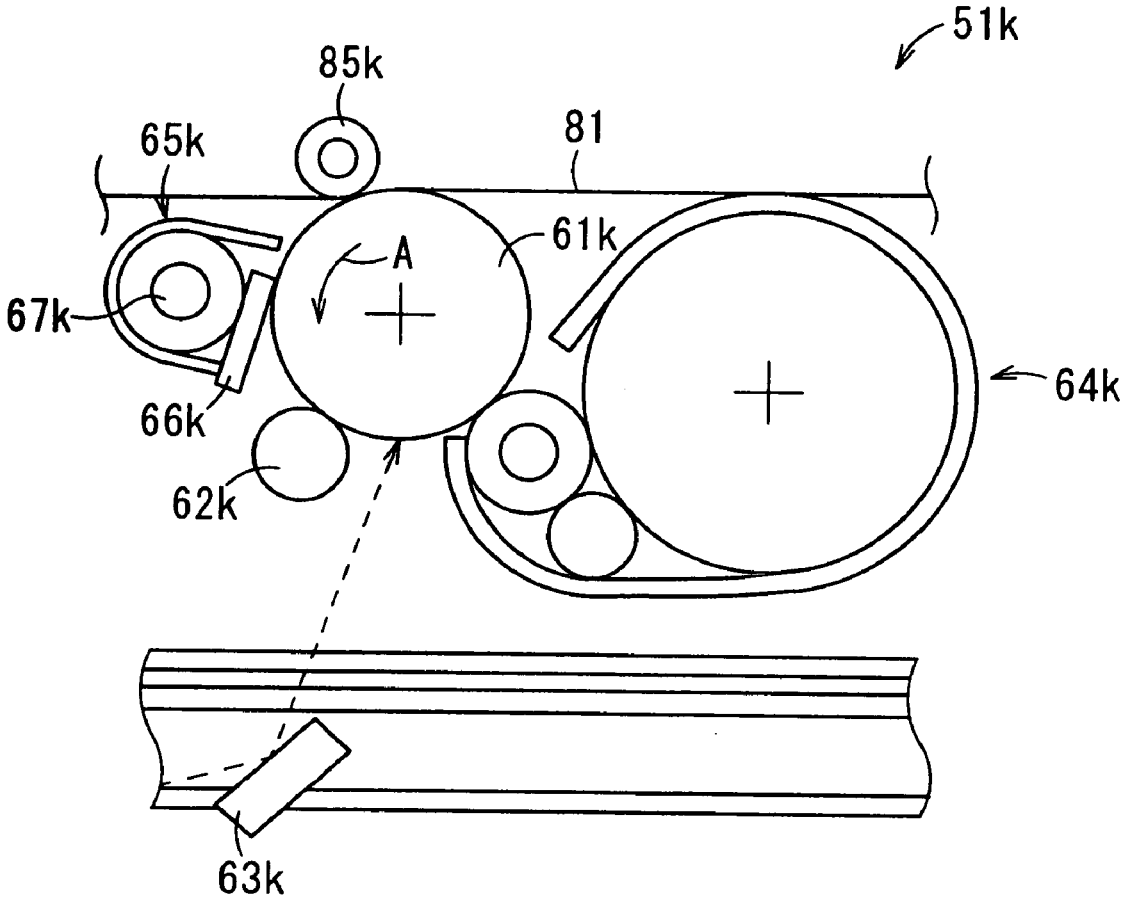
FIG. 8 is an enlarged view showing a part of an image forming unit.

FIG. 8 is an enlarged view showing a part of the image forming unit 51*k*. With reference to FIG. 4 and FIG. 8, the constitution of the image forming unit 51 will be described. The image forming unit 51*k* comprises a photoreceptor 61*k*, a charger 62*k*, an exposure portion 63*k*, a developing portion 64*k*, and a photoreceptor cleaning apparatus 65*k* serving as a cleaning section. The photoreceptor 61*k* has a drum shape, and on a surface of the photoreceptor 61*k* is formed an electrostatic latent image. The charger 62*k*, the exposure portion 63*k*, the developing portion 64*k*, and the photoreceptor cleaning apparatus 65*k* are disposed from an upstream side toward a downstream side in a rotation direction along an outer periphery of the photoreceptor 61*k* rotating in an arrow sign A direction. The exposure portion 63*k* irradiates the photoreceptor 61*k* with a light emitted from an exposure unit 70.

The charger 62*k* uniformly charges the surface of the photoreceptor 61*k*, and in the embodiment, a roller charger is used for the charger 62*k*. The charger 62*k* is disposed in contact with an outer peripheral face of the photoreceptor 61*k*. Note that the charger is not limited to the roller charger, but a brush charger, a charger type charger, or the like may be used, for example.

The exposure portion 63*k* irradiates the uniformly charged surface of the photoreceptor 61*k* with light in accordance with image information of a black color component so that an electrostatic latent image of black is formed. The exposure portion 63*k* is, as well as the exposure portions 63 of the other color components, a part of the exposure unit 70.

The exposure unit 70 produces an electrostatic latent image by irradiating each photoreceptor 61 with laser light for each color component on the basis of the image information used for image formation. The exposure unit 70 comprises: a laser scanning unit (abbreviated as LSU) 72 provided with a laser irradiating portion 71; a polygon mirror 73; and first reflecting mirror 74 and second reflecting mirror 63 for reflecting the laser light for each color component. The exposure portion 63 in the respective image forming unit 51 should be shown as a whole exposure unit 70 to be precise, but on showing a placement on the outer periphery of the photoreceptor 61, the second reflecting mirror 63 is referred to as the exposure portion 63 for the sake of convenience. The laser light emitted from the laser irradiating portion 71 is reflected on the exposure portion which indicates the first reflecting mirror 74 and the second reflecting mirror 63, via the polygon mirror 73 and then, the photoreceptor 61 for each color component is irradiated with the laser light. Note that LSU 72 may be configured so that, instead of the laser irradiating portion 71, a writing head is used in which light emitting elements such as EL (electro luminescence) and LED (light emitting diode) are arranged in an array.

The developing portion 64*k* supplies a toner, which is developer of black, to the electrostatic latent image formed on the surface of the photoreceptor 61*k* so that an image is developed. The photoreceptor cleaning apparatus 65*k* is disposed upstream of the charger 62*k* with respect to the rotation direction shown by the arrow sign A of the photoreceptor 61*k*. The photoreceptor cleaning apparatus 65*k* comprises a cleaning blade 66 and a photoreceptor waste toner conveying apparatus 67*k*. The cleaning blade 66*k* is disposed on the outer peripheral face of the photoreceptor 61*k* in abutment therewith so as to scrub off the remaining developer from the surface of the photoreceptor 61*k*, which developer has not been transferred onto the intermediate transfer body 52. The photoreceptor waste toner conveying apparatus 67*k* conveys the developer, which has been scrubbed off by the cleaning blade 66*k*, namely the waste toner, to the waste developer collecting port 13 of the developer collecting apparatus 1.

Note that, among the developer, basically a toner is supplied onto the photoreceptors 61 and therefore, the developer and the toner will be used in the same meaning after the developer moves to the photoreceptors 61.

In thus configured image forming units 51, in the embodiment, the image forming unit 51*k* for black is disposed at the farthest position from a transfer roller 91 included in an after-described transfer portion 53, and in a direction toward the transfer roller 91, sequentially arranged are an image forming unit 51*y* for yellow, an image forming unit 51*m* for magenta, and an image forming unit 51*c* for cyan in this order.

The intermediate transfer body 52 is disposed above the image forming units 51 so as to be in contact with the photoreceptors 61. The intermediate transfer body 52 comprises a transfer belt 81, a transfer belt driving roller 82, a transfer belt driven roller 83, a transfer belt tension mechanism 84, and an intermediate transfer roller 85. Note that, regarding the intermediate transfer roller 85, four intermediate transfer rollers (85*k*, 85*y*, 85*m*, and 85*c*) are respectively provided so as to correspond to the image forming unit 51 for each color component. The intermediate transfer body 52 forms a full-color toner image on the transfer belt 81 by sequentially stacking on the transfer belt 81 toner images of respective color components formed on the photoreceptors 61 so that the toner images are transferred onto the transfer belt 81.

The transfer belt 81 is formed of a film with no end, having a thickness of around 75 μm to 120 μm. Materials of the transfer belt 81 preferably include polyimide, polycarbonate, or the like. In addition, the transfer belt 81 is stretched out between the transfer belt driving roller 82 and the transfer belt driven roller 83 so that an outer surface of the transfer belt 81 comes into contact with the outer peripheral faces of the photoreceptors 61. The transfer belt 81 is driven to rotate in a sub-scanning direction (in an arrow sign B direction in FIG. 4) by rotary driving force of the transfer belt driving roller 82 while tension is given to the transfer belt 81 by the transfer belt tension mechanism 84.

Inside the case 58 of the image forming apparatus 50, the transfer belt driving roller 82 is disposed closer to one end of the case 58. The transfer belt driving roller 82 is capable of driving the stretched-out transfer belt 81 to rotate in the arrow sing B direction. In addition, the transfer belt driving roller 82 is capable of conveying the recording paper while having the overlaid transfer belt 81 and recording paper sandwiched in pressure-contact between the transfer roller 91 of the transfer belt 53 and the transfer belt driving roller 82.

Inside the case 58, the transfer belt driven roller 83 is disposed closer to the other end of the case 58. The transfer belt driven roller 83 stretches the transfer belt 81 out in cooperation with the transfer belt driving roller 82.

Each of the intermediate transfer rollers 85 is provided in contact with the inner peripheral face of the transfer belt 81, and in contact with the photoreceptor 61 via the transfer belt 81. The intermediate transfer roller 85 is provided with a shaft formed of metal (for example, stainless steel) having a diameter of 8 to 10 mm. An outer peripheral face of the metal shaft is covered with conductive elastic materials such as ethylene-propylene rubber (EPDM) and urethane foam, with the result that the intermediate transfer roller 85 is formed. To the intermediate transfer roller 85 thus configured is applied a high-voltage transfer bias, that is a high voltage having a polarity (+) opposite to a charge polarity (−) of the toner, in order to transfer the toner image formed on the photoreceptor 61 onto the transfer belt 81 of the intermediate transfer body 52, so that the high voltage is uniformly applied to the transfer belt 81 by the elastic material. The toner images developed on the respective photoreceptors 61 in accordance with respective color components are sequentially transferred onto the transfer belt 81 by the intermediate transfer roller 85, and then stacked thereon so that a desirable image is formed.

The transfer portion 53 comprises the transfer roller 91. The transfer roller 91 faces the transfer belt driving roller 82 in schematic horizontal and parallel direction thereto. The transfer roller 91 has a predetermined nip so as to come into pressure-contact with the transfer belt 81 attached to the transfer belt driving roller 82. To the transfer roller 91 is applied a voltage for transferring onto the recording paper the full-color toner image formed on the transfer belt 81, that is a high voltage having a polarity (+) opposite to the charge polarity (−) of the toner. Further, in order to constantly obtain the nip between the transfer belt 81 and the transfer roller 91, it is preferable that either one of the transfer belt driving roller 82 and the transfer roller 91 is formed of hard materials such as metal while the other one is formed of soft materials such as elastic rubber and foamed resin. Below the transfer belt driving roller 82 and the transfer roller 91 is provided a registration roller 92. The registration roller 92 conveys the recording paper to the transfer roller 91 so as to synchronizes a leading end of the recording paper supplied from the after-described feeding portion 55, with an end of the toner image on the transfer belt 81. The toner image formed on the transfer belt 81 is transferred by the high voltage applied to the transfer belt 91, onto the recording paper which is passing through the nip between the transfer belt 81 and the transfer roller 91.

Further, on the other side of the intermediate transfer body 52, that is closer to a position where the transfer belt driven roller 83 is disposed, is provided a transfer belt cleaning unit (hereinafter referred to as a transfer BCU 54) which is the transfer cleaning apparatus 54. The BCU 54 comprises a transfer body cleaning blade 93, a toner storage portion 94 having a box shape, and the transfer body waste toner conveying apparatus 95. The transfer body cleaning blade 93 is provided in contact with the transfer belt 81. The toner storage portion 94 once stores a toner scrubbed off from the transfer belt 81 by the transfer body cleaning blade 93, namely the waste toner. The transfer body waste toner conveying apparatus 95 is provided inside the toner storage portion 94 so as to convey the stored waste toner. The transfer BCU 54 is disposed upstream of the image forming units 51 and downstream of the transfer portion 53, with respect to a rotation direction of the transfer belt 81 (the arrow sign B direction). Moreover, on the transfer BCU 54, a portion of the transfer body cleaning blade 93 in contact with the outer surface of the transfer belt 81 is supported by the transfer belt driven roller 83 via the transfer belt 81.

As describe above, the toner attached to the transfer belt 81 by contact with the photoreceptor 61, and/or the residual toner which has not been completely transferred onto the recording paper at the transfer portion 53 are removed and collected by the transfer BCU 54 in order to prevent color mixture of the toner from being generated at next step.

With reference to the above-described FIG. 6 will be described positioning of the photoreceptor 61 through the developer collecting apparatus 1, and collection of the waste toner through the photoreceptor waste toner conveying apparatus 67 and the transfer body waste toner conveying apparatus 95. The photoreceptor 61 provided for each color component is rotatably supported by inserting photoreceptor shafts 60*k*, 60*y*, 60*m*, and 60*c*, respectively, into photoreceptor shaft supporting holes 12*k*, 12*y*, 12*m*, and 12*c* formed on the positioning frame 4 of the developer collecting apparatus 1. As described above, the positioning frame 4 is positioned by the case positioning members 11*a* and 11*b* so as to be mounted on the case 58 and therefore, each of the photoreceptors 61 is positioned by inserting the photoreceptor shafts 60*k*, 60*y*, 60*m*, and 60*c* into the photoreceptor shaft supporting holes 12*k*, 12*y*, 12*m*, and 12*c* formed at predetermined positions on the positioning frame 4.

The photoreceptor waste toner conveying apparatuses 67 respectively comprise a toner conveying case 101 having a tubular shape; and a conveying screw member 102. The conveying screw member 102 is rotatably provided inside the toner conveying case 101, which conveying screw member 102 has a rotary shaft and sequential protrusions spirally extending in a direction of the rotary shaft. One end portion of the photoreceptor waste toner conveying apparatus 67 protrudes more to the operation side of the image forming apparatus 50 than the mounting face 40 of the positioning frame 4 in the case 58. When mounting the positioning frame 4 on the image forming apparatus 50, the protruded portion is inserted into the waste developer collecting port 13 of the positioning frame 4 for positioning thereof.

The conveying screw member 102 of the photoreceptor waste toner conveying apparatus 67 is driven to rotate by a driving source (not shown). By rotation of the conveying screw member 102, the waste toner, which has been scrubbed off from the surface of the photoreceptor 61 by the cleaning blade 66 and then stored inside the toner conveying case 101, is conveyed to the waste developer collecting port 13 of the positioning frame 4. The waste toner conveyed to the waste developer collecting port 13 passes through the waste developer passing hole 15, and then through the waste developer passage 14, so as to be collected in the waste developer container 2.

The transfer body waste toner conveying apparatus 95 is also configured similarly to the photoreceptor waste toner conveying apparatus 67. The transfer body waste toner conveying apparatus 95 comprises: a transfer body waste toner conveying case 103 having a tubular shape; and a transfer body waste toner conveying screw member 104. The transfer body waste toner conveying screw member 104 is rotatably provided inside the transfer body waste toner conveying case 103, which transfer body waste toner conveying screw member 104 has a rotary shaft and sequential protrusions spirally extending in a direction of the rotary shaft. One end portion of the transfer body waste toner conveying apparatus 95 protrudes more to the operation side of the image forming apparatus 50 than the mounting face 40 of the positioning frame 4 in the case 58. When mounting the positioning frame 4 on the image forming apparatus 50, the protruded portion is inserted into the waste developer collecting port 13 of the positioning frame 4 for positioning thereof.

In the transfer body waste toner conveying apparatus 95, the following operation is carried out as in the case of the photoreceptor waste toner conveying apparatus 67. By rotation of the transfer body waste toner conveying screw member 104 of the transfer body waste toner conveying apparatus 95, the waste toner, which has been scrubbed off from the surface of the transfer belt 81 by the transfer body cleaning blade 93 and then stored inside the transfer body waste toner conveying case 103, is conveyed to the waste developer collecting port 13*e* of the positioning frame 4. The waste toner conveyed to the waste developer collecting port 13*e* passes through the waste developer passing hole 15*e*, and then through the waste developer passage 14*e*, so as to be collected in the waste developer container 2.

With reference back to FIG. 4 again, the recording paper, onto which the toner image has been totally transferred at the transfer portion 53, is treated with a fixing process at the fixing portion 56. The fixing portion 56 is disposed above the transfer portion 53. The fixing portion 56 comprises a pair of fixing rollers of a heating roller 105 and a pressure roller 106; and a conveying roller 107 disposed above the fixing rollers. The recording paper, onto which the toner image has been transferred, is conveyed from a lower side to an upper side of the fixing rollers. The toner image is fixed to the recording paper at the fixing portion 56 as follows. A fixing temperature is kept to a predetermined level by controlling heating means (not shown) such as a heater lamp provided inside or closer to the heating roller 105, on the basis of a detected value through a temperature detector. The recording paper, onto which the toner image has been transferred, is sandwiched between the heating roller 105 and the pressure roller 106 which rotate so as to convey the recording paper while heating and pressurizing the recording paper.

Above the fixing portion 56 is provided a discharging roller 108. The recording paper, which has been conveyed by the conveying roller 107, is discharged by the discharging roller 108 onto a catch tray which is the discharging portion 57.

Furthermore, a duplex document conveying path S3 for duplex printing is provided adjacent to the fixing portion 56. The duplex document conveying path S3 is formed from a back side of the fixing portion 56, toward a lower side of the fixing portion 56, down to a vicinity of the feeding portion 55. Through the duplex document conveying path S3, the recording paper in an inverted state is conveyed back again toward the transfer roller 91 by a pair of first conveying rollers 109 and a pair of second conveying rollers 110 each of which pair is arranged along the conveying path. In more detail, the first conveying rollers 109 are disposed behind the fixing portion 56 while the second conveying rollers 110 are located below the first conveying rollers 109. The second conveying rollers 110 are disposed at a horizontal position schematically identical to that of the registration roller 92.

Next, the feeding portion 55 for supplying the recording paper to the transfer portion 53 will be described. The feeding portion 55 is provided below the image forming units 51. The feeding portion 55 comprises a manual tray 111 and a feeding cassette 112 for storing the recording papers to be used for image information. The feeding portion 55 supplies the recording papers sheet by sheet from the manual tray 111 or the feeding cassette 112 to the transfer portion 53.

The manual tray 111 is provided on one side portion of the case 58 of the image forming apparatus 50 so that the manual tray 111 can be expansively opened outward when used, and housed in the one side portion when not used. Only a small number (necessary number) of recording papers of which type the operator desires, are placed on the manual tray 111 so that the recording papers are taken sheet by sheet into the case 58 of the image forming apparatus 50. Below the exposure unit 70, a pickup roller 113 is provided downstream of a feeding direction (an arrow sign C direction in FIG. 4) of the recording paper through the manual tray 111. Further downstream of the feeding (C) direction, a third conveying roller 114, a fourth conveying roller 115, and a fifth conveying roller 116 are provided.

The pickup roller 113 is in contact with a surface on the one end portion of the recording paper fed from the manual tray 111, and reliably conveys the recording papers sheet by sheet, using friction resistance of the roller. The fifth conveying roller 116 on the lowest stream in the feeding direction is provided above the third conveying roller 114 and the fourth conveying roller 115, with the result that the recording paper can be conveyed upward. The pickup roller 113, the third conveying roller 114, the fourth conveying roller 115, and the fifth conveying roller 116 constitute a recording paper conveying path S1.

Meanwhile, the feeding cassette 112 is provided below the image forming units 51 inside the case 58 and the exposure unit 70. The feeding cassette 112 is capable of accommodating a large amount of recording paper sheets of which size is set in a specification of an apparatus or predetermined by the operator. Above one end portion of the feeding cassette 112 is provided another pickup roller 117. Downstream of a recording paper conveying direction (an arrow sign D direction in FIG. 4) of the pickup roller 117, a sixth conveying roller 118 is provided obliquely above the another pickup roller 117. The another pickup roller 117 is in contact with a surface on one end portion of recording paper situated at the uppermost portion of the recording papers set on the feeding cassette 112, so as to convey the recording papers by bringing out the recording papers reliably sheet by sheet using the friction resistance of the roller. The sixth conveying roller 118 conveys to the transfer portion 53 the recording paper, which has been brought out from the another pickup roller 117, upward along a recording paper conveying path S2 formed closer to one end portion inside the case 58.

Hereinafter will be described an image forming operation through the image forming apparatus 50 according to the embodiment.

At the outset, the outer peripheral face of the photoreceptor 61 is uniformly charged to a predetermined potential by the charger 62. By irradiating the charged photoreceptor 61 with laser light from the exposure unit 70 which laser light is in accordance with image information, an electrostatic latent image for each color component is produced on each of the photoreceptors 61. Next, a toner as developer is supplied from the developer portion 64 to the outer peripheral face of the photoreceptor 61, so that the electrostatic latent image formed on the outer peripheral face of the photoreceptor 61 is developed by the toner to form a toner image.

The toner images for respective color components formed on the photoreceptors 61 are sequentially stacked and transferred onto the transfer belt 81 of the intermediate transfer body 52 by the intermediate transfer roller 85, so that a full-color toner image will be formed. The full-color toner image transferred onto the transfer belt 81 is totally transferred onto the recording paper by applying at the transfer roller 91 the transfer bias to the recording paper supplied from the manual tray 111 or the feeding cassette 112 of the feeding portion 55, when the transfer belt 81 has moved to the transfer portion 53.

The recording paper onto which the toner image has been transferred is conveyed to the fixing portion 56 where the toner image is fixed by heat onto the recording paper. The recording paper onto which the toner image has been transferred is, in a case of one-side printing request, discharged face down onto the discharging portion 57 by the discharging roller 108.

On the other hand, in a case of a duplex printing request, the recording paper is held by the discharging roller 108 and then, the discharging roller 108 is made to rotate in a reverse direction so that the recording paper is led to the duplex document conveying path S3 and conveyed again to the registration roller 92 by the first conveying roller 109 and the second conveying roller 110. At the time, compared to the former operation, an opposite face of the recording paper is treated with transferring while the recording paper is conveyed in a changed cross direction. That is to say, a leading end of the recording paper during a first transfer becomes a tail end thereof during a rear face transfer while a tail end of the recording paper during the first transfer becomes a leading end thereof during the rear face transfer. Onto the rear face of the recording paper is transferred the toner image. After the toner image is fixed by heat onto the recording paper, the recording paper is discharged onto the discharging portion 57 by the discharging roller 108. As described above, a series of the image forming operations onto the recording paper are carried out.

In this image forming process, the residual toner on the surface of the photoreceptor 61 and the residual toner on the surface of the transfer belt 81 are removed by the photoreceptor cleaning apparatus 65 and the transfer body cleaning apparatus (transfer BCU) 54. The residual toners removed from the surface of the photoreceptor 61 and the surface of the transfer belt 81 are conveyed to the developer collecting apparatus 1 by the photoreceptor waste toner conveying apparatus 67 and the transfer body waste toner conveying apparatus 95, and collected in the waste developer container 2 of the developer collecting apparatus 1.

The image forming apparatus 50 of the invention for carrying out such a series of image forming (printing) processes is characterized in being constituted so as to be capable of conducting control over the print processing operation according to the detected result that the amount of the waste developer accommodated in the waste developer container 2 of the developer collecting apparatus 1 has reached a level of a nearly full state.

Figure 9:
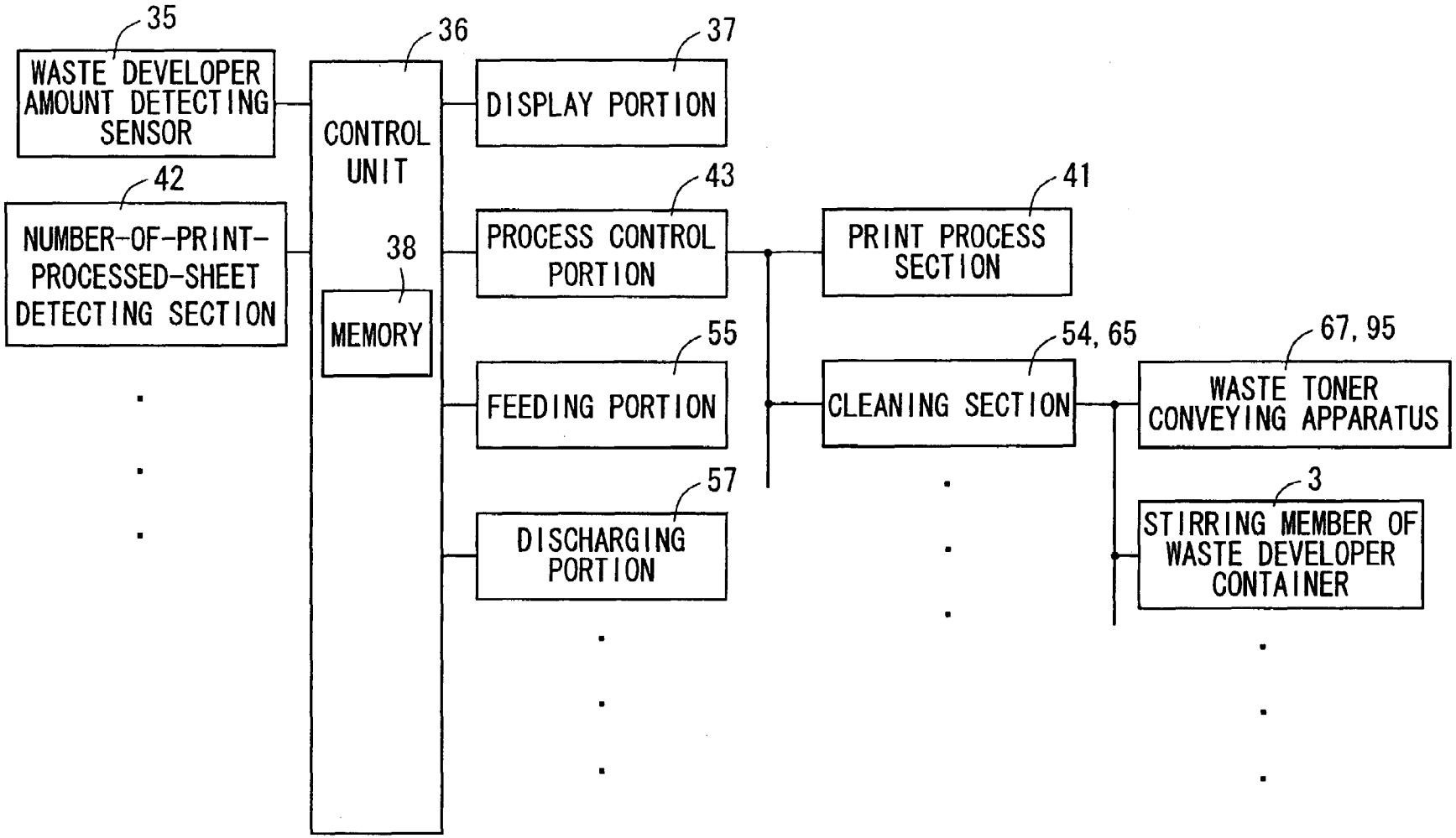
FIG. 9 is a block view showing a constitution according to the control operation of the control unit provided in the image forming apparatus of the invention.

FIG. 9 is a block view showing a constitution according to the control operation of the control unit 36 provided in the image forming apparatus 50 of the invention. Although the control unit 36 of the image forming apparatus 50 conduct control over the entire operations according to the image formation, FIG. 9 only shows a part of the operations which part is in accordance with the hereinbelow-described features of the control of the invention.

The image forming apparatus 50 comprises the control unit 36 for controlling the apparatus to perform the entire operation according to the image formation, and for the control unit 36, the above-described control unit 36 of the developer collecting apparatus 1 is used also in the image forming apparatus 50. To be more precise, operational control is conducted over the developer collecting apparatus 1 by the control unit 36 of the image forming apparatus 50 as part of the entire operations for the image formation in the image forming apparatus 50. Moreover, also for the display portion 37, the display portion 37 provided on the operating portion of the image forming apparatus 50 is used also as the display portion 37 of the developer collecting apparatus 1. Accordingly, as described about the control system of the developer collecting apparatus 1, to the control unit 36 is connected the waste developer amount detecting sensor 35 at an input side and the display portion 37 at an output side.

To the control unit 36 is connected at the input side a number-of-print-processed-sheet detecting section 42 for detecting the number of the recording paper which have been treated with the print processing by the print processing section 41. Further, to the control unit 36 are connected at the output side a process control portion 43, the feeding portion 55, the discharging portion 57, and the like. The process control portion 43 is a process circuit for treating with the print processing (image formation) the recording paper supplied from the feeding portion 55, as well as conducting operational control over all parts which carry out removal of the waste developer generated upon the print processing, or other operations. To this process control portion 43 are further connected the print processing section 41, the cleaning sections (the photoreceptor cleaning apparatus and the transfer body cleaning apparatus) 65 and 54, and the like so that control over the operations is carried out. To the cleaning sections 54 and 65 are connected the stirring member 3 provided in the waste developer container 2, and other components so that control over the operations is carried out.

Although other components for enabling the image formation are connected to the control unit 36 at the input side and the output side, drawings of such components are omitted in order to avoid intricacy.

The number-of-print-processed-sheet detecting section 42 is provided at a position, for example, that the number-of-print-processed-sheet detecting section 42 can detect a recording paper which has been print-processed at the print processing section 41. The number-of-print-processed-sheet detecting section 42 is realized by a counter which, for example, optically detects the print-processed recording paper being conveyed, and counts the number of the passing recording paper. Note that a system of the number-of-print-processed-sheet detecting section 42 is not limited to the above system, but may be a system in which data of the number of the printed sheets inputted from the operating portion of the image forming apparatus 50 as a printing condition is counted, and moreover may be a system in which data of the number of the printed sheets inputted from an external apparatus including a personal computer or the like as a print command is counted, and furthermore may be a system in which these systems are used in combination with each other.

According to the detected output through the waste developer amount detecting sensor 35, the control unit 36 predicts remaining capacity of the waste developer container 2 before being filled up with the waste developer, that is, the amount of the waste developer which can be accommodated from the nearly full state to the full state, and then on the basis of the remaining capacity, obtains a predicted number of print-processable sheets which indicates the predictable number of recording paper to be print-processed until the waste developer container 2 becomes full of the waste developer.

A method of obtaining the predicted number of the print-processable sheets is not particularly limited, and various methods are applicable. For example, when the image forming apparatus and the developer are specified, a preliminary test is conducted in which an image having standard size and standard print ratio is practically formed on a recording paper from the nearly full state to the full state, and the average number of printable sheets is determined as the predicted number of the print-processable sheets and previously stored in the memory 38. In this case, by an operation of reading out the predicted number of the print-processable sheets from the memory 38, it is possible to obtain the predicted number of the print-processable sheets.

Further, a designed full amount of the waste developer container 2 is divided by an average value of the amount of waste developer generated in a case of printing one sheet of the recording paper which average value has been obtained in the preliminary test, and a total number of printable sheets until the full state is obtained and stored in the memory 38, and an accumulated number of recording paper which has been practically print-processed upon detection of the nearly full state, is deducted from the total number of printable sheets read out from the memory 38, and thus obtained difference may be determined as the predicted number of print-processable sheets.

Further, the amount of the waste developer inside the waste developer container at the time of detection of the nearly full state (which amount can be obtained on a design phase by determining a nearly full state detection rotational load) is divided by an actual value of the accumulated number of the recording paper which has been print-processed until the time of detection of the nearly full state, to obtain an actual average value of the amount of waste developer generated in the case of printing one sheet of the recording paper, and thus obtained difference between the designed full amount of the waste developer and the designed nearly full amount of the waste developer (which difference can also be previously calculated and then stored in the memory 38) is divided by the actual average value of the amount of waste developer, and thus obtained value may be determined as the predicted number of the print-processable sheets.

In the embodiment is used a method of obtaining the predicted number of the print-processable sheets by reading out from the memory 38 the predicted number of the print-processable sheets which has been obtained in the conducted preliminary test for actual print processing from the nearly full state to the full state, and previously stored in the memory 38.

According to the detected output through the waste developer amount detecting sensor 35 of the developer collecting apparatus 1, the control unit 36 of the image forming apparatus 50 compares the accumulated value of number of the recording paper to be print-processed by the print processing section 41 after reception of the detected output, with the predicted number of the print-processed sheet obtained by being read out from the memory 38, and when the accumulated value of number of the recording paper reaches the predicted number of the print-processable sheets, an operational command can be outputted to the print processing section 41 to stop the print processing. By so doing, the image forming apparatus 50 can reliably execute the print processing until the waste developer container 2 becomes full of the waste developer and furthermore, it is possible to prevent the waste developer container 2 to overflow, with the result that it is possible to prevent pollution inside the apparatus due to the waste developer.

Figure 10B:
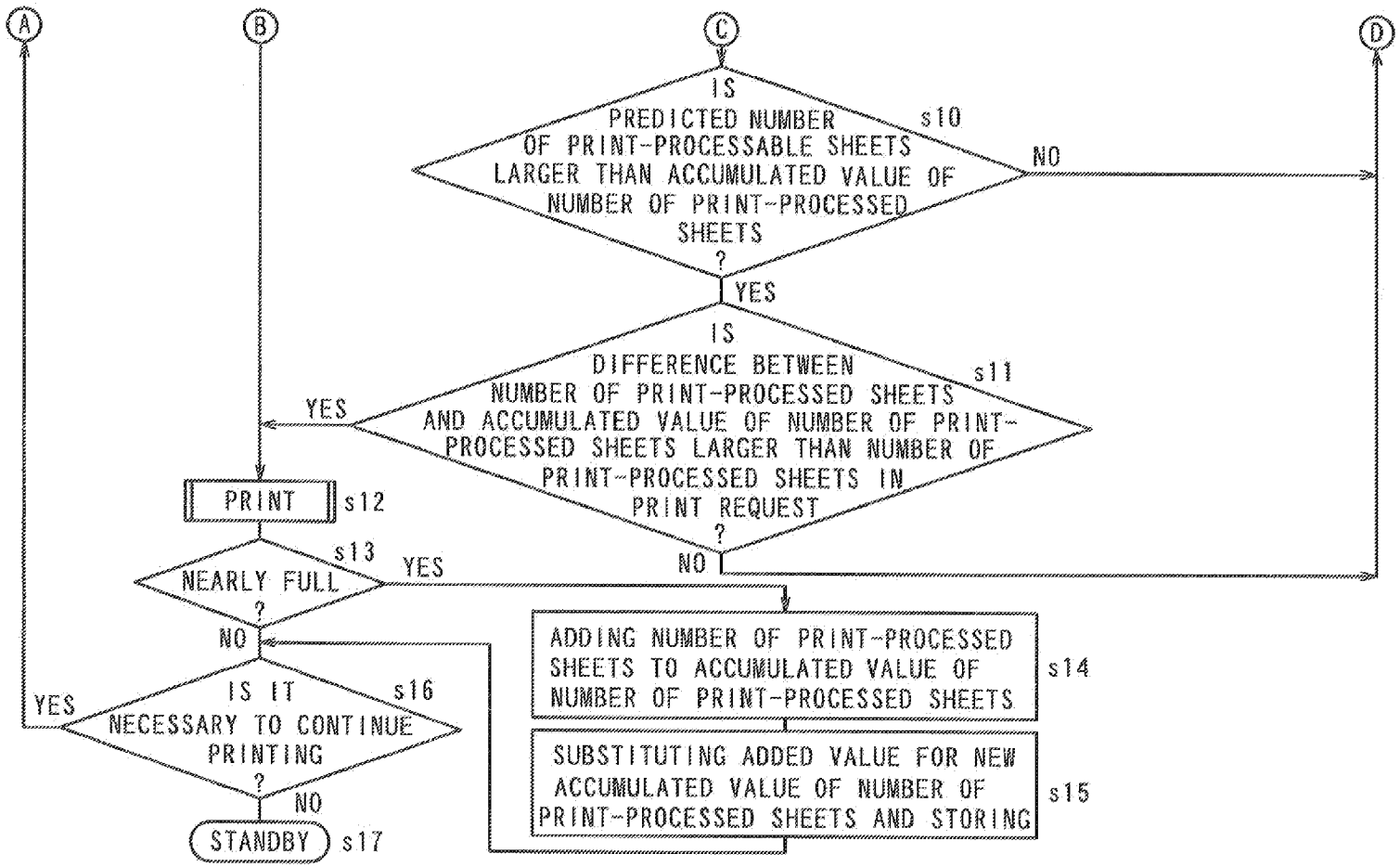

FIGS. 10A and 10B are flow charts of assistance in explaining a print processing control operation of the control unit 36 on the basis of the detected result that the amount of waste developer being accommodated in the waste developer container 2 reaches a level of the nearly full state.

At step s0, an electric power switch of the image forming apparatus 50 is turned on so that a start-up of initial state is completed. At the time, the image forming apparatus 50 is in a standby state waiting a print request from the operator.

At step s1, the operator inputs the print request serving as a command signal for initiating the printing operation, from an operating portion of the image forming apparatus 50. At step s2, a confirming operation of the print request is carried out and it is determined whether or not the inputted print request contains data of print conditions. In a case where the inputted print request does not contain the data of print conditions, the operation proceeds to step s3 where an instruction to input print conditions is displayed on the display portion 37, and returns to step s1.

At step s4, it is determined whether or not the waste developer amount detecting sensor 35 is in a state of having the switch on, that is, whether or not the waste developer container 2 is in the nearly full state. When in the nearly full state, the operation proceeds to step s5. At step s5, an instruction to replace the waste developer container is displayed on the display portion 37. At step s6, it is determined whether or not the waste developer container 2 has been replaced. Note that this determination is conducted by the control unit 36 on the basis of a signal which is detected by a waste developer container detecting switch (not shown) provided on the developer collecting apparatus 1. However, in a case of replacing the waste developer container 2, such replacing works are performed by the operator.

In a case where the waste developer container 2 has been replaced with an empty container, the operation proceeds to the step s7, and the accumulated value of number of the print-processed sheets is reset to zero (0) which accumulated value of number of the print-processed sheets indicates an accumulated value stored in the memory 38 and also indicates an accumulated value of number of the recording paper printed by the print processing section 41 after detection of the nearly full state. After the accumulated value of number of the print-processed sheets has been reset to 0, the operation returns to step s4 and proceeds to the following steps. However, because the waste developer container 2 has been replaced, the nearly full state is not detected at step s4, and the operation proceeds to the print processing at step s12 which will be hereinafter described.

In a case where the waste developer container 2 has not been replaced at step s6, the operation proceeds to step s8. At step s8, after the detection of the nearly full state, the accumulated value of number of the print-processed sheets which indicates the accumulated number of the print-processed recording paper, is read out from the memory 38. At step s9, the predicted number of the print-processable sheets which indicates the number of the recording paper that can be print-processed until the waste developer container 2 is brought to the full state.

At step s10, it is determined whether or not the predicted number of the print-processable sheets is larger than the accumulated value of number of the print-processable sheets. That is to say, it is determined whether or not there is a margin of the number of the sheets (hereinafter will be referred to margin number of sheets) which can be print-processed until the waste developer container 2 is brought to the full state. In a case of having no margin number of sheets, the operation returns to step s4, and the same flow until replacement of the waste developer container 2 will be repeated, and when the waste developer container 2 is replaced at step s6, the operation can proceed to the print processes from step s4 to step s12.

In a case of having some margin number of sheets, the operation proceeds to step s11. At step s11, it is determined whether or not the margin number of sheets is larger than the number of the print-processable sheets upon the print processing which number is inputted in the print request. That is to say, it is determined whether or not the waste developer container 2 will be brought to the full state in the course of the print processing. In a case where the waste developer container 2 will be brought to the full state in the course of the print processing, the operation returns to step s4, and the same flow until the replacement of the waste developer container 2 is repeated. In a case where the waste developer container 2 is not brought to the full state, the operation proceeds to step s12 so that the print processing is carried out.

At step s13, after the print processing, it is determined again whether or not the waste developer container 2 is in the nearly full state. In a case where the operation proceeds from step s11 to step s13 via step s12, the waste developer container 2 is in the nearly full state and therefore, the operation proceeds to step s14. Further, in a case where the operation proceeds from step s4 to step s13 via step s12, the operation proceeds to step s14 when the waste developer container 2 is brought to the nearly full state by the print processing in this occasion. At step s14, the number of the recording paper which are print-processed in this occasion is added to the accumulated value of number of the print-processed sheets, and at step s15, the added value is substituted for a new accumulated value of the print-processed sheets and stored in the memory 38 and then, the operation proceeds to step s16.

In the meantime, even when the print processing at step s12 is carried out, the waste developer container 2 is not brought to the nearly full state and then, the operation proceeds to step s16. At step s16, it is determined whether or not a next print request has been inputted. When the next print request has been inputted, the operation returns to step s4 and proceeds to the following steps. When the next print request has not been inputted, a standby state at step s17 is brought.

In the flow chart in FIG. 10, only in a case where the margin number of sheets is larger than the number of the print-processed sheets in the print request as is determined at step s11, the operation proceeds to the print processing, but this constitution is not restrictive and the following flow is applicable. Regardless of size relation in number between the margin number of sheets and the number of the print-processed sheets in the print request, the print processing at step s12 is carried out, and for every one sheet of the print-processed recording paper, addition into the accumulated value of number of the print-processed sheets is conducted, and when the accumulated value of number of the print-processed sheets reaches the predicted number of the print-processable sheets, the control unit 36 makes the print processing section 41 to stop the print processing operation, and the operation returns to step s5 where the instruction to replace the waste developer container is displayed so as to replace the waste developer container 2.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A developer collecting apparatus for an image forming apparatus comprising an image forming unit composed of an image bearing member on which an electrostatic latent image is formed by being exposed to light in accordance with image information, and a developing portion for forming a developer image by developing the electrostatic latent image on the image bearing member; an intermediate transfer body onto which the developer image formed on the image bearing member is transferred; a transfer portion for totally transferring onto a recording medium the developer image transferred on the intermediate transfer body; and a cleaning section for removing from the image bearing member and the intermediate transfer body, residual developer remaining on the image bearing member which is not transferred from the image bearing member onto the intermediate transfer body, and residual developer remaining on the intermediate transfer body which is not transferred from the intermediate transfer body onto the recording medium, the developer collecting apparatus which collects developer removed from the image bearing member and the intermediate transfer body by the cleaning section, the developer collecting apparatus comprising:

a positioning frame for positioning the image bearing member to be mounted onto an image forming apparatus main body;

a waste developer container detachably mounted on the positioning frame, for accommodating waste developer removed by the cleaning section;

a stirring member rotatably provided in the waste developer container, for stirring waste developer accommodated in the waste developer container; and a driving section for giving a rotary driving force to the stirring member, the driving section having:

a driving source; and a first driving force transmitting path and a second driving force transmitting path which are coupled to the driving source, for transmitting the rotary driving force to the stirring member, and when a rotational load on the first driving force transmitting path reaches a predetermined level or more, switchover of transmitting path for transmitting the rotary driving force to the stirring member is performed from the first driving force transmitting path to the second driving force transmitting path.

2. The developer collecting apparatus of claim 1, wherein the first driving force transmitting path is provided on an extended line of a rotary shaft of the stirring member, and a first driving force transmitting shaft which is provided in the first driving force transmitting path and coupled to an output shaft of the driving source, is coupled to a rotary shaft of the stirring member in a state where the rotational load is less than the predetermined level, and detached from the rotary shaft of the stirring member in a state where the rotational load is the predetermined level or more.

3. The developer collecting apparatus of claim 2, wherein the first driving force transmitting shaft has a first gear mounted in a vicinity of a shaft end portion close to the driving source, and the rotary shaft of the stirring member has a second gear mounted in a vicinity of an end portion of the rotary shaft, facing the first driving force transmitting shaft, and the second driving force transmitting path has:

a second driving force transmitting shaft; and a third gear and a fourth gear which are respectively mounted in a vicinity of both end portions in an axial direction of the second driving force transmitting shaft, and when the first driving force transmitting shaft is detached from the rotary shaft of the stirring member, the third gear of the second driving force transmitting shaft engages with the first gear of the first driving force transmitting shaft while the forth gear of the second driving force transmitting shaft engages with the second gear of the stirring member, whereby transmitting the rotary driving force of the driving source to the stirring member.

4. The developer collecting apparatus of claim 2, further comprising a waste developer amount detecting sensor for detecting that an amount of the waste developer accommodated in the waste developer container reaches a predetermined amount, the waste developer amount detecting sensor detecting movement of the first driving force transmitting shaft when detached from the rotary shaft of the stirring member, whereby detecting that the amount of the waste developer being accommodated in the waste developer container reaches the predetermined amount.

5. The developer collecting apparatus of claim 4, further comprising:

a display portion on which information can be displayed; and a control unit for outputting to the display portion an operational command for display of information, the control unit making the display portion display replacement instruction information of the waste developer container, according to a detected output through the waste developer amount detecting sensor.

6. An image forming apparatus comprising:

the developer collecting apparatus of claim 4; and a control unit for conducting control over operations of entire components according to image formation, the control unit which predicts in accordance with the detected output through the waste developer amount detecting sensor, a remaining capacity of the waste developer container until the waste developer container becomes full of the waste developer, and on a basis of the remaining capacity, obtains a predicted number of print-processable sheets, which is a predicted number of recording mediums that can be print-processed until the waste developer container becomes full of the waste developer.

7. The image forming apparatus of claim 6, further comprising:

a print processing section for print-processing a recording medium, being composed of an image forming unit having an image bearing member on which an electrostatic latent image is formed by exposure to light according to image information and a developing portion for developing the electrostatic latent image on the image bearing member into a developer image, an intermediate transfer body onto which the developer image formed on the image bearing member is transferred, and a transfer portion for totally transferring onto the recording medium the developer image which has been transferred onto the intermediate transfer body; and a number-of-print-processed-sheet detecting section for detecting a number of recording mediums which have been print-processed by the print processing section, wherein the control unit outputs an operational command to the print processing section to stop the print processing when an accumulated value of number of recording mediums reaches a predicted number of print-processable sheets, the recording mediums being print-processed in accordance with the detected output through the waste developer amount detecting sensor by the print processing section after receipt of the detected output.

* * * * *